US010036338B2

(12) United States Patent
Fuxman et al.

(10) Patent No.: US 10,036,338 B2
(45) Date of Patent: Jul. 31, 2018

(54) CONDITION-BASED POWERTRAIN CONTROL SYSTEM

(71) Applicant: Honeywell International Inc., Morris Plains, NJ (US)

(72) Inventors: Adrian Matias Fuxman, North Vancouver (CA); Daniel Pachner, Praha (CZ)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/139,035

(22) Filed: Apr. 26, 2016

(65) Prior Publication Data

US 2017/0306871 A1 Oct. 26, 2017

(51) Int. Cl.

| | |
|---|---|
| ***F01P 7/00*** | (2006.01) |
| ***F02D 45/00*** | (2006.01) |
| ***F02D 41/02*** | (2006.01) |
| ***F01P 7/02*** | (2006.01) |
| ***F01P 7/16*** | (2006.01) |

(Continued)

(52) U.S. Cl.

CPC ..... *F02D 41/021* (2013.01); *F01P 7/026* (2013.01); *F01P 7/16* (2013.01); *F01P 7/167* (2013.01); *F02D 41/26* (2013.01); *F02D 41/28* (2013.01); *F01P 2025/40* (2013.01); *F01P 2025/42* (2013.01); *F01P 2025/44* (2013.01); *F01P 2025/46* (2013.01); *F02D 2041/281* (2013.01)

(58) Field of Classification Search

CPC .. F02D 41/021; F02D 41/28; F02D 2041/281; F01P 7/026; F01P 7/16; F01P 7/167; F01M 5/005; F01M 5/007; F01M 2005/004

USPC ..... 123/196 AB

See application file for complete search history.

(56) References Cited

U.S. PATENT DOCUMENTS

| | | | |
|---|---|---|---|
| 3,744,461 | A | 7/1973 | Davis |
| 4,005,578 | A | 2/1977 | McInerney |

(Continued)

FOREIGN PATENT DOCUMENTS

| | | | |
|---|---|---|---|
| CN | 102063561 | A | 5/2011 |
| CN | 102331350 | A | 1/2012 |

(Continued)

OTHER PUBLICATIONS

Delphi, Delphi Diesel NOx Trap (DNT), 3 pages, Feb. 2004.

(Continued)

*Primary Examiner* — Hai Huynh

(74) *Attorney, Agent, or Firm* — Seager Tufte & Wickhem LLP

(57) ABSTRACT

A system and approach for development of setpoints for a controller of a powertrain system. The controller may be parametrized as a function of setpoints to provide performance variables that are considered acceptable by a user or operator for current operating conditions of the engine or powertrain. The controller may determine set point trajectories in real time during operation of the powertrain system and determine positions of manipulated variables do drive controlled variables to associated and determined set point trajectories. The present system and approach may determine set point trajectories for powertrain conditions on-line and in real time, whereas set point trajectories have previously been determined off-line for powertrain control.

21 Claims, 5 Drawing Sheets

(51) Int. Cl.
*F02D 41/28* (2006.01)
*F02D 41/26* (2006.01)

(56) References Cited

U.S. PATENT DOCUMENTS 4,055,158 A 10/1977 Marsee
4,206,606 A 6/1980 Yamada
4,252,098 A 2/1981 Tomczak et al.
4,359,991 A 11/1982 Stumpp et al.
4,383,441 A 5/1983 Willis et al.
4,426,982 A 1/1984 Lehner et al.
4,438,497 A 3/1984 Willis et al.
4,440,140 A 4/1984 Kawagoe et al.
4,456,883 A 6/1984 Bullis et al.
4,485,794 A 12/1984 Kimberley et al.
4,601,270 A 7/1986 Kimberley et al.
4,616,308 A 10/1986 Morshedi et al.
4,653,449 A 3/1987 Kamel et al.
4,671,235 A 6/1987 Hosaka
4,735,181 A 4/1988 Kaneko et al.
4,947,334 A 8/1990 Massey et al.
4,962,570 A 10/1990 Hosaka et al.
5,044,337 A 9/1991 Williams
5,076,237 A 12/1991 Hartman et al.
5,089,236 A 2/1992 Clerc
5,094,213 A 3/1992 Dudek et al.
5,095,874 A 3/1992 Schnaibel et al.
5,108,716 A 4/1992 Nishizawa et al.
5,123,397 A 6/1992 Richeson
5,150,289 A 9/1992 Badavas
5,186,081 A 2/1993 Richardson et al.
5,233,829 A 8/1993 Komatsu
5,270,935 A 12/1993 Dudek et al.
5,273,019 A 12/1993 Matthews et al.
5,282,449 A 2/1994 Takahashi et al.
5,293,553 A 3/1994 Dudek et al.
5,349,816 A 9/1994 Sanbayashi et al.
5,365,734 A 11/1994 Takeshima
5,394,322 A 2/1995 Hansen
5,394,331 A 2/1995 Dudek et al.
5,398,502 A 3/1995 Watanabe
5,408,406 A 4/1995 Mathur et al.
5,431,139 A 7/1995 Grutter et al.
5,452,576 A 9/1995 Hamburg et al.
5,477,840 A 12/1995 Neumann
5,560,208 A 10/1996 Halimi et al.
5,570,574 A 11/1996 Yamashita et al.
5,598,825 A 2/1997 Neumann
5,609,139 A 3/1997 Ueda et al.
5,611,198 A 3/1997 Lane et al.
5,682,317 A 10/1997 Keeler et al.
5,690,086 A 11/1997 Kawano et al.
5,692,478 A 12/1997 Nogi et al.
5,697,339 A 12/1997 Esposito
5,704,011 A 12/1997 Hansen et al.
5,740,033 A 4/1998 Wassick et al.
5,746,183 A 5/1998 Parke et al.
5,765,533 A 6/1998 Nakajima
5,771,867 A 6/1998 Amstutz et al.
5,785,030 A 7/1998 Paas
5,788,004 A 8/1998 Friedmann et al.
5,842,340 A 12/1998 Bush et al.
5,846,157 A 12/1998 Reinke et al.
5,893,092 A 4/1999 Driscoll
5,917,405 A 6/1999 Joao
5,924,280 A 7/1999 Tarabulski
5,942,195 A 8/1999 Lecea et al.
5,964,199 A 10/1999 Atago et al.
5,970,075 A 10/1999 Wasada
5,974,788 A 11/1999 Hepburn et al.
5,995,895 A 11/1999 Wall et al.
6,029,626 A 2/2000 Bruestle
6,035,640 A 3/2000 Kolmanovsky et al.
6,048,620 A 4/2000 Zhong
6,048,628 A 4/2000 Hilman et al.
6,055,810 A 5/2000 Borland et al.
6,056,781 A 5/2000 Wassick et al.
6,058,700 A 5/2000 Yamashita et al.
6,067,800 A 5/2000 Kolmanovsky et al.
6,076,353 A 6/2000 Freudenberg et al.
6,105,365 A 8/2000 Deeba et al.
6,122,555 A 9/2000 Lu
6,134,883 A 10/2000 Kato et al.
6,153,159 A 11/2000 Engeler et al.
6,161,528 A 12/2000 Akao et al.
6,170,259 B1 1/2001 Boegner et al.
6,171,556 B1 1/2001 Burk et al.
6,178,743 B1 1/2001 Hirota et al.
6,178,749 B1 1/2001 Kolmanovsky et al.
6,208,914 B1 3/2001 Ward et al.
6,216,083 B1 4/2001 Ulyanov et al.
6,233,922 B1 5/2001 Maloney
6,236,956 B1 5/2001 Mantooth et al.
6,237,330 B1 5/2001 Takahashi et al.
6,242,873 B1 6/2001 Drozdz et al.
6,263,672 B1 7/2001 Roby et al.
6,273,060 B1 8/2001 Cullen
6,279,551 B1 8/2001 Iwano et al.
6,312,538 B1 11/2001 Latypov et al.
6,314,351 B1 11/2001 Chutorash
6,314,662 B1 11/2001 Ellis, III
6,314,724 B1 11/2001 Kakuyama et al.
6,321,538 B2 11/2001 Hasler et al.
6,327,361 B1 12/2001 Harshavardhana et al.
6,338,245 B1 1/2002 Shimoda et al.
6,341,487 B1 1/2002 Takahashi et al.
6,347,619 B1 2/2002 Whiting et al.
6,360,159 B1 3/2002 Miller et al.
6,360,541 B2 3/2002 Waszkiewicz et al.
6,360,732 B1 3/2002 Bailey et al.
6,363,715 B1 4/2002 Bidner et al.
6,363,907 B1 4/2002 Arai et al.
6,379,281 B1 4/2002 Collins et al.
6,389,203 B1 5/2002 Jordan et al.
6,425,371 B2 7/2002 Majima
6,427,436 B1 8/2002 Allansson et al.
6,431,160 B1 8/2002 Sugiyama et al.
6,445,963 B1 9/2002 Blevins et al.
6,446,430 B1 9/2002 Roth et al.
6,453,308 B1 9/2002 Zhao et al.
6,463,733 B1 10/2002 Zhao et al.
6,463,734 B1 10/2002 Tamura et al.
6,466,893 B1 10/2002 Latwesen et al.
6,470,682 B2 10/2002 Gray, Jr.
6,470,862 B2 10/2002 Isobe et al.
6,470,886 B1 10/2002 Jestrabek-Hart
6,481,139 B2 11/2002 Weldle
6,494,038 B2 12/2002 Kobayashi et al.
6,502,391 B1 1/2003 Hirota et al.
6,505,465 B2 1/2003 Kanazawa et al.
6,510,351 B1 1/2003 Blevins et al.
6,512,974 B2 1/2003 Houston et al.
6,513,495 B1 2/2003 Franke et al.
6,532,433 B2 3/2003 Bharadwaj et al.
6,542,076 B1 4/2003 Joao
6,546,329 B2 4/2003 Bellinger
6,549,130 B1 4/2003 Joao
6,550,307 B1 4/2003 Zhang et al.
6,553,754 B2 4/2003 Meyer et al.
6,560,528 B1 5/2003 Gitlin et al.
6,560,960 B2 5/2003 Nishimura et al.
6,571,191 B1 5/2003 York et al.
6,579,206 B2 6/2003 Liu et al.
6,591,605 B2 7/2003 Lewis
6,594,990 B2 7/2003 Kuenstler et al.
6,601,387 B2 8/2003 Zurawski et al.
6,612,293 B2 9/2003 Schweinzer et al.
6,615,584 B2 9/2003 Ostertag
6,625,978 B1 9/2003 Eriksson et al.
6,629,408 B1 10/2003 Murakami et al.
6,637,382 B1 10/2003 Brehob et al.
6,644,017 B2 11/2003 Takahashi et al.
6,647,710 B2 11/2003 Nishiyama et al.
6,647,971 B2 11/2003 Vaughan et al.

(56) References Cited

U.S. PATENT DOCUMENTS

| | | | |
|---|---|---|---|
| 6,651,614 | B2 | 11/2003 | Flamig-Vetter et al. |
| 6,662,058 | B1 | 12/2003 | Sanchez |
| 6,666,198 | B2 | 12/2003 | Mitsutani |
| 6,666,410 | B2 | 12/2003 | Boelitz et al. |
| 6,671,596 | B2 | 12/2003 | Kawashima et al. |
| 6,671,603 | B2 | 12/2003 | Cari et al. |
| 6,672,052 | B2 | 1/2004 | Taga et al. |
| 6,672,060 | B1 | 1/2004 | Buckland et al. |
| 6,679,050 | B1 | 1/2004 | Takahashi et al. |
| 6,687,597 | B2 | 2/2004 | Sulatisky et al. |
| 6,688,283 | B2 | 2/2004 | Jaye |
| 6,694,244 | B2 | 2/2004 | Meyer et al. |
| 6,694,724 | B2 | 2/2004 | Tanaka et al. |
| 6,705,084 | B2 | 3/2004 | Allen et al. |
| 6,718,254 | B2 | 4/2004 | Hashimoto et al. |
| 6,718,753 | B2 | 4/2004 | Bromberg et al. |
| 6,725,208 | B1 | 4/2004 | Hartman et al. |
| 6,736,120 | B2 | 5/2004 | Sumilla |
| 6,738,682 | B1 | 5/2004 | Pasadyn |
| 6,739,122 | B2 | 5/2004 | Kitajima et al. |
| 6,742,330 | B2 | 6/2004 | Genderen |
| 6,743,352 | B2 | 6/2004 | Ando et al. |
| 6,748,936 | B2 | 6/2004 | Kinomura et al. |
| 6,752,131 | B2 | 6/2004 | Poola et al. |
| 6,752,135 | B2 | 6/2004 | McLaughlin et al. |
| 6,757,579 | B1 | 6/2004 | Pasadyn |
| 6,758,037 | B2 | 7/2004 | Terada et al. |
| 6,760,631 | B1 | 7/2004 | Berkowitz et al. |
| 6,760,657 | B2 | 7/2004 | Katoh |
| 6,760,658 | B2 | 7/2004 | Yasui et al. |
| 6,770,009 | B2 | 8/2004 | Badillo et al. |
| 6,772,585 | B2 | 8/2004 | Iihoshi et al. |
| 6,775,623 | B2 | 8/2004 | Ali et al. |
| 6,779,344 | B2 | 8/2004 | Hartman et al. |
| 6,779,512 | B2 | 8/2004 | Mitsutani |
| 6,788,072 | B2 | 9/2004 | Nagy et al. |
| 6,789,533 | B1 | 9/2004 | Hashimoto et al. |
| 6,792,927 | B2 | 9/2004 | Kobayashi |
| 6,804,618 | B2 | 10/2004 | Junk |
| 6,814,062 | B2 | 11/2004 | Esteghlal et al. |
| 6,817,171 | B2 | 11/2004 | Zhu |
| 6,823,667 | B2 | 11/2004 | Braun et al. |
| 6,826,903 | B2 | 12/2004 | Yahata et al. |
| 6,827,060 | B2 | 12/2004 | Huh |
| 6,827,061 | B2 | 12/2004 | Nytomt et al. |
| 6,827,070 | B2 | 12/2004 | Fehl et al. |
| 6,834,497 | B2 | 12/2004 | Miyoshi et al. |
| 6,837,042 | B2 | 1/2005 | Colignon et al. |
| 6,839,637 | B2 | 1/2005 | Moteki et al. |
| 6,849,030 | B2 | 2/2005 | Yamamoto et al. |
| 6,857,264 | B2 | 2/2005 | Ament |
| 6,873,675 | B2 | 3/2005 | Kurady et al. |
| 6,874,467 | B2 | 4/2005 | Hunt et al. |
| 6,879,906 | B2 | 4/2005 | Makki et al. |
| 6,882,929 | B2 | 4/2005 | Liang et al. |
| 6,904,751 | B2 | 6/2005 | Makki et al. |
| 6,911,414 | B2 | 6/2005 | Kimura et al. |
| 6,915,779 | B2 | 7/2005 | Sriprakash |
| 6,920,865 | B2 | 7/2005 | Lyon |
| 6,923,902 | B2 | 8/2005 | Ando et al. |
| 6,925,372 | B2 | 8/2005 | Yasui |
| 6,925,796 | B2 | 8/2005 | Nieuwstadt et al. |
| 6,928,362 | B2 | 8/2005 | Meaney |
| 6,928,817 | B2 | 8/2005 | Ahmad |
| 6,931,840 | B2 | 8/2005 | Strayer et al. |
| 6,934,931 | B2 | 8/2005 | Plumer et al. |
| 6,941,744 | B2 | 9/2005 | Tanaka |
| 6,945,033 | B2 | 9/2005 | Sealy et al. |
| 6,948,310 | B2 | 9/2005 | Roberts, Jr. et al. |
| 6,953,024 | B2 | 10/2005 | Linna et al. |
| 6,965,826 | B2 | 11/2005 | Andres et al. |
| 6,968,677 | B2 | 11/2005 | Tamura |
| 6,971,258 | B2 | 12/2005 | Rhodes et al. |
| 6,973,382 | B2 | 12/2005 | Rodriguez et al. |
| 6,978,744 | B2 | 12/2005 | Yuasa et al. |
| 6,988,017 | B2 | 1/2006 | Pasadyn et al. |
| 6,990,401 | B2 | 1/2006 | Neiss et al. |
| 6,996,975 | B2 | 2/2006 | Radhamohan et al. |
| 7,000,379 | B2 | 2/2006 | Makki et al. |
| 7,013,637 | B2 | 3/2006 | Yoshida |
| 7,016,779 | B2 | 3/2006 | Bowyer |
| 7,028,464 | B2 | 4/2006 | Rosel et al. |
| 7,039,475 | B2 | 5/2006 | Sayyarrodsari et al. |
| 7,047,938 | B2 | 5/2006 | Flynn et al. |
| 7,050,863 | B2 | 5/2006 | Mehta et al. |
| 7,052,434 | B2 | 5/2006 | Makino et al. |
| 7,055,311 | B2 | 6/2006 | Beutel et al. |
| 7,059,112 | B2 | 6/2006 | Bidner et al. |
| 7,063,080 | B2 | 6/2006 | Kita et al. |
| 7,067,319 | B2 | 6/2006 | Wills et al. |
| 7,069,903 | B2 | 7/2006 | Surnilla et al. |
| 7,082,753 | B2 | 8/2006 | Dalla Betta et al. |
| 7,085,615 | B2 | 8/2006 | Persson et al. |
| 7,106,866 | B2 | 9/2006 | Astorino et al. |
| 7,107,978 | B2 | 9/2006 | Itoyama |
| 7,111,450 | B2 | 9/2006 | Surnilla |
| 7,111,455 | B2 | 9/2006 | Okugawa et al. |
| 7,113,835 | B2 | 9/2006 | Boyen et al. |
| 7,117,046 | B2 | 10/2006 | Boyden et al. |
| 7,124,013 | B2 | 10/2006 | Yasui |
| 7,149,590 | B2 | 12/2006 | Martin et al. |
| 7,151,976 | B2 | 12/2006 | Lin |
| 7,152,023 | B2 | 12/2006 | Das |
| 7,155,334 | B1 | 12/2006 | Stewart et al. |
| 7,164,800 | B2 | 1/2007 | Sun |
| 7,165,393 | B2 | 1/2007 | Betta et al. |
| 7,165,399 | B2 | 1/2007 | Stewart |
| 7,168,239 | B2 | 1/2007 | Ingram et al. |
| 7,182,075 | B2 | 2/2007 | Shahed et al. |
| 7,184,845 | B2 | 2/2007 | Sayyarrodsari et al. |
| 7,184,992 | B1 | 2/2007 | Polyak et al. |
| 7,188,637 | B2 | 3/2007 | Dreyer et al. |
| 7,194,987 | B2 | 3/2007 | Mogi |
| 7,197,485 | B2 | 3/2007 | Fuller |
| 7,200,988 | B2 | 4/2007 | Yamashita |
| 7,204,079 | B2 | 4/2007 | Audoin |
| 7,212,908 | B2 | 5/2007 | Li et al. |
| 7,275,374 | B2 | 10/2007 | Stewart et al. |
| 7,275,415 | B2 | 10/2007 | Rhodes et al. |
| 7,277,010 | B2 | 10/2007 | Joao |
| 7,281,368 | B2 | 10/2007 | Miyake et al. |
| 7,292,926 | B2 | 11/2007 | Schmidt et al. |
| 7,302,937 | B2 | 12/2007 | Ma et al. |
| 7,321,834 | B2 | 1/2008 | Chu et al. |
| 7,323,036 | B2 | 1/2008 | Boyden et al. |
| 7,328,577 | B2 | 2/2008 | Stewart et al. |
| 7,337,022 | B2 | 2/2008 | Wojsznis et al. |
| 7,349,776 | B2 | 3/2008 | Spillane et al. |
| 7,357,125 | B2 | 4/2008 | Kolavennu |
| 7,375,374 | B2 | 5/2008 | Chen et al. |
| 7,376,471 | B2 | 5/2008 | Das et al. |
| 7,380,547 | B1 | 6/2008 | Ruiz |
| 7,383,118 | B2 | 6/2008 | Imai et al. |
| 7,389,773 | B2 | 6/2008 | Stewart et al. |
| 7,392,129 | B2 | 6/2008 | Hill et al. |
| 7,397,363 | B2 | 7/2008 | Joao |
| 7,398,082 | B2 | 7/2008 | Schwinke et al. |
| 7,398,149 | B2 | 7/2008 | Ueno et al. |
| 7,400,933 | B2 | 7/2008 | Rawlings et al. |
| 7,400,967 | B2 | 7/2008 | Ueno et al. |
| 7,413,583 | B2 | 8/2008 | Langer et al. |
| 7,415,389 | B2 | 8/2008 | Stewart et al. |
| 7,418,372 | B2 | 8/2008 | Nishira et al. |
| 7,430,854 | B2 | 10/2008 | Yasui et al. |
| 7,433,743 | B2 | 10/2008 | Pistikopoulos et al. |
| 7,444,191 | B2 | 10/2008 | Caldwell et al. |
| 7,444,193 | B2 | 10/2008 | Cutler |
| 7,447,554 | B2 | 11/2008 | Cutler |
| 7,467,614 | B2 | 12/2008 | Stewart et al. |
| 7,469,177 | B2 | 12/2008 | Samad et al. |
| 7,474,953 | B2 | 1/2009 | Hulser et al. |
| 7,493,236 | B1 | 2/2009 | Mock et al. |
| 7,505,879 | B2 | 3/2009 | Tomoyasu et al. |
| 7,505,882 | B2 | 3/2009 | Jenny et al. |

(56) References Cited

U.S. PATENT DOCUMENTS

| | | | |
|---|---|---|---|
| 7,515,975 | B2 | 4/2009 | Stewart |
| 7,522,963 | B2 | 4/2009 | Boyden et al. |
| 7,536,232 | B2 | 5/2009 | Boyden et al. |
| 7,577,483 | B2 | 8/2009 | Fan et al. |
| 7,587,253 | B2 | 9/2009 | Rawlings et al. |
| 7,591,135 | B2 | 9/2009 | Stewart |
| 7,599,749 | B2 | 10/2009 | Sayyarrodsari et al. |
| 7,599,750 | B2 | 10/2009 | Piche |
| 7,603,185 | B2 | 10/2009 | Stewart et al. |
| 7,603,226 | B2 | 10/2009 | Henein |
| 7,627,843 | B2 | 12/2009 | Dozorets et al. |
| 7,630,868 | B2 | 12/2009 | Turner et al. |
| 7,634,323 | B2 | 12/2009 | Vermillion et al. |
| 7,634,417 | B2 | 12/2009 | Boyden et al. |
| 7,650,780 | B2 | 1/2010 | Hall |
| 7,668,704 | B2 | 2/2010 | Perchanok et al. |
| 7,676,318 | B2 | 3/2010 | Allain |
| 7,698,004 | B2 | 4/2010 | Boyden et al. |
| 7,702,519 | B2 | 4/2010 | Boyden et al. |
| 7,712,139 | B2 | 5/2010 | Westendorf et al. |
| 7,721,030 | B2 | 5/2010 | Fuehrer et al. |
| 7,725,199 | B2 | 5/2010 | Brackney et al. |
| 7,734,291 | B2 | 6/2010 | Mazzara, Jr. |
| 7,738,975 | B2 | 6/2010 | Denison et al. |
| 7,743,606 | B2 | 6/2010 | Havelena et al. |
| 7,748,217 | B2 | 7/2010 | Muller |
| 7,752,840 | B2 | 7/2010 | Stewart |
| 7,765,792 | B2 | 8/2010 | Rhodes et al. |
| 7,779,680 | B2 | 8/2010 | Sasaki et al. |
| 7,793,489 | B2 | 9/2010 | Wang et al. |
| 7,798,938 | B2 | 9/2010 | Matsubara et al. |
| 7,808,371 | B2 | 10/2010 | Blanchet et al. |
| 7,813,884 | B2 | 10/2010 | Chu et al. |
| 7,826,909 | B2 | 11/2010 | Attarwala |
| 7,831,318 | B2 | 11/2010 | Bartee et al. |
| 7,840,287 | B2 | 11/2010 | Wojsznis et al. |
| 7,844,351 | B2 | 11/2010 | Piche |
| 7,844,352 | B2 | 11/2010 | Vouzis et al. |
| 7,846,299 | B2 | 12/2010 | Backstrom et al. |
| 7,850,104 | B2 | 12/2010 | Havlena et al. |
| 7,856,966 | B2 | 12/2010 | Saitoh |
| 7,860,586 | B2 | 12/2010 | Boyden et al. |
| 7,861,518 | B2 | 1/2011 | Federle |
| 7,862,771 | B2 | 1/2011 | Boyden et al. |
| 7,877,239 | B2 | 1/2011 | Grichnik et al. |
| 7,878,178 | B2 | 2/2011 | Stewart et al. |
| 7,891,669 | B2 | 2/2011 | Araujo et al. |
| 7,904,280 | B2 | 3/2011 | Wood |
| 7,905,103 | B2 | 3/2011 | Larsen et al. |
| 7,907,769 | B2 | 3/2011 | Sammak et al. |
| 7,925,399 | B2 | 4/2011 | Comeau |
| 7,930,044 | B2 | 4/2011 | Attarwala |
| 7,933,849 | B2 | 4/2011 | Bartee et al. |
| 7,958,730 | B2 | 6/2011 | Stewart et al. |
| 7,970,482 | B2 | 6/2011 | Srinivasan et al. |
| 7,987,145 | B2 | 7/2011 | Baramov |
| 7,996,140 | B2 | 8/2011 | Stewart et al. |
| 8,001,767 | B2 | 8/2011 | Kakuya et al. |
| 8,019,911 | B2 | 9/2011 | Dressler et al. |
| 8,025,167 | B2 | 9/2011 | Schneider et al. |
| 8,032,235 | B2 | 10/2011 | Sayyar-Rodsari |
| 8,046,089 | B2 | 10/2011 | Renfro et al. |
| 8,046,090 | B2 | 10/2011 | MacArthur et al. |
| 8,060,290 | B2 | 11/2011 | Stewart et al. |
| 8,078,291 | B2 | 12/2011 | Pekar et al. |
| 8,108,790 | B2 | 1/2012 | Morrison, Jr. et al. |
| 8,109,255 | B2 | 2/2012 | Stewart et al. |
| 8,121,818 | B2 | 2/2012 | Gorinevsky |
| 8,145,329 | B2 | 3/2012 | Pekar et al. |
| 8,146,850 | B2 | 4/2012 | Havlena et al. |
| 8,157,035 | B2 | 4/2012 | Whitney et al. |
| 8,185,217 | B2 | 5/2012 | Thiele |
| 8,197,753 | B2 | 6/2012 | Boyden et al. |
| 8,200,346 | B2 | 6/2012 | Thiele |
| 8,209,963 | B2 | 7/2012 | Kesse et al. |
| 8,229,163 | B2 | 7/2012 | Coleman et al. |
| 8,245,501 | B2 | 8/2012 | He et al. |
| 8,246,508 | B2 | 8/2012 | Matsubara et al. |
| 8,265,854 | B2 | 9/2012 | Stewart et al. |
| 8,281,572 | B2 | 10/2012 | Chi et al. |
| 8,295,951 | B2 | 10/2012 | Crisalle et al. |
| 8,311,653 | B2 | 11/2012 | Zhan et al. |
| 8,312,860 | B2 | 11/2012 | Yun et al. |
| 8,316,235 | B2 | 11/2012 | Boehl et al. |
| 8,360,040 | B2 | 1/2013 | Stewart et al. |
| 8,370,052 | B2 * | 2/2013 | Lin ..... F01P 11/16 123/41.08 |
| 8,379,267 | B2 | 2/2013 | Mestha et al. |
| 8,396,644 | B2 | 3/2013 | Kabashima et al. |
| 8,402,268 | B2 | 3/2013 | Dierickx |
| 8,418,441 | B2 | 4/2013 | He et al. |
| 8,453,431 | B2 | 6/2013 | Wang et al. |
| 8,473,079 | B2 | 6/2013 | Havlena |
| 8,478,506 | B2 | 7/2013 | Grichnik et al. |
| RE44,452 | E | 8/2013 | Stewart et al. |
| 8,504,175 | B2 | 8/2013 | Pekar et al. |
| 8,505,278 | B2 | 8/2013 | Farrell et al. |
| 8,543,170 | B2 | 9/2013 | Mazzara, Jr. et al. |
| 8,555,613 | B2 | 10/2013 | Wang et al. |
| 8,571,689 | B2 | 10/2013 | Macharia et al. |
| 8,596,045 | B2 | 12/2013 | Tuomivaara et al. |
| 8,620,461 | B2 | 12/2013 | Kihas |
| 8,634,940 | B2 | 1/2014 | Macharia et al. |
| 8,639,925 | B2 | 1/2014 | Schuetze |
| 8,649,884 | B2 | 2/2014 | MacArthur et al. |
| 8,649,961 | B2 | 2/2014 | Hawkins et al. |
| 8,667,288 | B2 | 3/2014 | Yavuz |
| 8,694,197 | B2 | 4/2014 | Rajagopalan et al. |
| 8,700,291 | B2 | 4/2014 | Herrmann |
| 8,751,241 | B2 | 6/2014 | Oesterling et al. |
| 8,762,026 | B2 | 6/2014 | Wolfe et al. |
| 8,763,377 | B2 | 7/2014 | Yacoub |
| 8,768,996 | B2 | 7/2014 | Shokrollahi et al. |
| 8,813,690 | B2 | 8/2014 | Kumar et al. |
| 8,825,243 | B2 | 9/2014 | Yang et al. |
| 8,839,967 | B2 | 9/2014 | Schneider et al. |
| 8,867,746 | B2 | 10/2014 | Ceskutti et al. |
| 8,892,221 | B2 | 11/2014 | Kram et al. |
| 8,899,018 | B2 | 12/2014 | Frazier et al. |
| 8,904,760 | B2 | 12/2014 | Mital |
| 8,983,069 | B2 | 3/2015 | Merchan et al. |
| 9,100,193 | B2 | 8/2015 | Newsome et al. |
| 9,141,996 | B2 | 9/2015 | Christensen et al. |
| 9,170,573 | B2 | 10/2015 | Kihas |
| 9,175,595 | B2 * | 11/2015 | Ceynow ..... F01M 5/005 |
| 9,223,301 | B2 | 12/2015 | Stewart et al. |
| 9,243,576 | B2 | 1/2016 | Yu et al. |
| 9,253,200 | B2 | 2/2016 | Schwarz et al. |
| 9,325,494 | B2 | 4/2016 | Boehl |
| 9,367,701 | B2 | 6/2016 | Merchan et al. |
| 9,367,968 | B2 | 6/2016 | Giraud et al. |
| 9,483,881 | B2 | 11/2016 | Comeau et al. |
| 9,560,071 | B2 | 1/2017 | Ruvio et al. |
| 9,779,742 | B2 | 10/2017 | Newsome, Jr. |
| 2002/0112469 | A1 | 8/2002 | Kanazawa et al. |
| 2004/0006973 | A1 | 1/2004 | Makki et al. |
| 2004/0086185 | A1 | 5/2004 | Sun |
| 2004/0144082 | A1 | 7/2004 | Mianzo et al. |
| 2004/0199481 | A1 | 10/2004 | Hartman et al. |
| 2004/0226287 | A1 | 11/2004 | Edgar et al. |
| 2005/0171667 | A1 | 8/2005 | Morita |
| 2005/0187643 | A1 | 8/2005 | Sayyar-Rodsari et al. |
| 2005/0193739 | A1 | 9/2005 | Brunnell et al. |
| 2005/0210868 | A1 | 9/2005 | Funabashi |
| 2006/0047607 | A1 | 3/2006 | Boyden et al. |
| 2006/0111881 | A1 | 5/2006 | Jackson |
| 2006/0137347 | A1 | 6/2006 | Stewart et al. |
| 2006/0168945 | A1 | 8/2006 | Samad et al. |
| 2006/0185626 | A1 | 8/2006 | Allen et al. |
| 2006/0212140 | A1 | 9/2006 | Brackney |
| 2007/0144149 | A1 | 6/2007 | Kolavennu et al. |
| 2007/0156259 | A1 | 7/2007 | Baramov et al. |
| 2007/0240213 | A1 | 10/2007 | Karam et al. |
| 2007/0261648 | A1 | 11/2007 | Reckels et al. |

(56) References Cited

U.S. PATENT DOCUMENTS

| | | | | |
|---|---|---|---|---|
| 2007/0275471 | A1 | 11/2007 | Coward | |
| 2008/0010973 | A1 | 1/2008 | Gimbres | |
| 2008/0103747 | A1 | 5/2008 | Macharia et al. | |
| 2008/0132178 | A1 | 6/2008 | Chatterjee et al. | |
| 2008/0208778 | A1 | 8/2008 | Sayyar-Rodsari et al. | |
| 2008/0289605 | A1* | 11/2008 | Ito | F01L 13/0063 123/435 |
| 2009/0172416 | A1 | 7/2009 | Bosch et al. | |
| 2009/0312998 | A1 | 12/2009 | Berckmans et al. | |
| 2010/0122523 | A1 | 5/2010 | Vosz | |
| 2010/0126481 | A1 | 5/2010 | Willi et al. | |
| 2010/0300069 | A1 | 12/2010 | Herrmann et al. | |
| 2011/0056265 | A1 | 3/2011 | Yacoub | |
| 2011/0060424 | A1 | 3/2011 | Havlena | |
| 2011/0125295 | A1 | 5/2011 | Bednasch et al. | |
| 2011/0131017 | A1 | 6/2011 | Cheng et al. | |
| 2011/0167025 | A1 | 7/2011 | Danai et al. | |
| 2011/0173315 | A1 | 7/2011 | Aguren | |
| 2011/0264353 | A1 | 10/2011 | Atkinson et al. | |
| 2011/0270505 | A1 | 11/2011 | Chaturvedi et al. | |
| 2012/0024089 | A1 | 2/2012 | Couey et al. | |
| 2012/0109620 | A1 | 5/2012 | Gaikwad et al. | |
| 2012/0174187 | A1 | 7/2012 | Argon et al. | |
| 2013/0024069 | A1 | 1/2013 | Wang et al. | |
| 2013/0067894 | A1 | 3/2013 | Stewart et al. | |
| 2013/0111878 | A1 | 5/2013 | Pachner et al. | |
| 2013/0111905 | A1 | 5/2013 | Pekar et al. | |
| 2013/0131954 | A1 | 5/2013 | Yu et al. | |
| 2013/0131956 | A1 | 5/2013 | Thibault et al. | |
| 2013/0158834 | A1 | 6/2013 | Wagner et al. | |
| 2013/0204403 | A1 | 8/2013 | Zheng et al. | |
| 2013/0242706 | A1 | 9/2013 | Newsome, Jr. | |
| 2013/0326232 | A1 | 12/2013 | Lewis et al. | |
| 2013/0326630 | A1 | 12/2013 | Argon | |
| 2013/0338900 | A1 | 12/2013 | Ardanese et al. | |
| 2014/0032189 | A1 | 1/2014 | Hehle et al. | |
| 2014/0034460 | A1 | 2/2014 | Chou | |
| 2014/0171856 | A1 | 6/2014 | McLaughlin et al. | |
| 2014/0258736 | A1 | 9/2014 | Merchan et al. | |
| 2014/0270163 | A1 | 9/2014 | Merchan | |
| 2014/0316683 | A1 | 10/2014 | Whitney et al. | |
| 2014/0318216 | A1 | 10/2014 | Singh | |
| 2014/0343713 | A1 | 11/2014 | Ziegler et al. | |
| 2014/0358254 | A1 | 12/2014 | Chu et al. | |
| 2015/0121071 | A1 | 4/2015 | Schwarz et al. | |
| 2015/0275783 | A1 | 10/2015 | Wong et al. | |
| 2015/0321642 | A1 | 11/2015 | Schwepp et al. | |
| 2015/0324576 | A1 | 11/2015 | Quirant et al. | |
| 2015/0334093 | A1 | 11/2015 | Mueller | |
| 2015/0354877 | A1 | 12/2015 | Burns et al. | |
| 2016/0003180 | A1 | 1/2016 | McNulty et al. | |
| 2016/0043832 | A1 | 2/2016 | Ahn et al. | |
| 2016/0108732 | A1 | 4/2016 | Huang et al. | |
| 2016/0127357 | A1 | 5/2016 | Zibuschka et al. | |
| 2016/0216699 | A1 | 7/2016 | Pekar et al. | |
| 2016/0239593 | A1 | 8/2016 | Pekar et al. | |
| 2016/0259584 | A1 | 9/2016 | Schlottmann et al. | |
| 2016/0330204 | A1 | 11/2016 | Baur et al. | |
| 2016/0344705 | A1 | 11/2016 | Stumpf et al. | |
| 2016/0362838 | A1 | 12/2016 | Badwe et al. | |
| 2016/0365977 | A1 | 12/2016 | Boutros et al. | |
| 2017/0031332 | A1 | 2/2017 | Santin | |
| 2017/0048063 | A1 | 2/2017 | Mueller | |
| 2017/0126701 | A1 | 5/2017 | Glas et al. | |
| 2017/0218860 | A1 | 8/2017 | Pachner et al. | |
| 2017/0300713 | A1 | 10/2017 | Fan et al. | |
| 2017/0306871 | A1 | 10/2017 | Fuxman et al. | |

FOREIGN PATENT DOCUMENTS

| | | | | |
|---|---|---|---|---|
| DE | 19628796 | C1 | 10/1997 | |
| DE | 10219382 | A1 | 11/2002 | |
| DE | 102009016509 | A1 | 10/2010 | |
| DE | 102011103346 | A1 | 8/2012 | |
| EP | 0301527 | A2 | 2/1989 | |
| EP | 0877309 | B1 | 6/2000 | |
| EP | 1134368 | A2 | 9/2001 | |
| EP | 1180583 | A2 | 2/2002 | |
| EP | 1221544 | A2 | 7/2002 | |
| EP | 1225490 | A2 | 7/2002 | |
| EP | 1245811 | A2 | 10/2002 | |
| EP | 1273337 | A1 | 1/2003 | |
| EP | 0950803 | B1 | 9/2003 | |
| EP | 1420153 | A2 | 5/2004 | |
| EP | 1447727 | A2 | 8/2004 | |
| EP | 1498791 | A1 | 1/2005 | |
| EP | 1425642 | B1 | 11/2005 | |
| EP | 1686251 | A1 | 8/2006 | |
| EP | 1399784 | B1 | 10/2007 | |
| EP | 2107439 | A1 | 10/2009 | |
| EP | 2146258 | A1 | 1/2010 | |
| EP | 1794339 | B1 | 7/2011 | |
| EP | 1529941 | B1 | 11/2011 | |
| EP | 2543845 | A1 | 1/2013 | |
| EP | 2551480 | A1 | 1/2013 | |
| EP | 2589779 | A2 | 5/2013 | |
| EP | 2617975 | A1 | 7/2013 | |
| EP | 2267559 | B1 | 1/2014 | |
| EP | 2919079 | A2 | 9/2015 | |
| JP | 59190433 | A | 10/1984 | |
| JP | 2010282618 | A | 12/2010 | |
| WO | 0144629 | A2 | 6/2001 | |
| WO | WO 01/69056 | * | 9/2001 | F01P 7/16 |
| WO | 0232552 | A1 | 4/2002 | |
| WO | 02097540 | A1 | 12/2002 | |
| WO | 02101208 | A1 | 12/2002 | |
| WO | 03023538 | A2 | 3/2003 | |
| WO | 03048533 | A1 | 6/2003 | |
| WO | 03065135 | A1 | 8/2003 | |
| WO | 03078816 | A1 | 9/2003 | |
| WO | 03102394 | A1 | 12/2003 | |
| WO | 2004027230 | A1 | 4/2004 | |
| WO | 2006021437 | A1 | 3/2006 | |
| WO | 2007078907 | A2 | 7/2007 | |
| WO | 2008033800 | A2 | 3/2008 | |
| WO | 2008115911 | A1 | 9/2008 | |
| WO | 2012076838 | A2 | 6/2012 | |
| WO | 2013119665 | A1 | 8/2013 | |
| WO | 2014165439 | A2 | 10/2014 | |
| WO | 2016053194 | A1 | 4/2016 | |

OTHER PUBLICATIONS

Diehl et al., "Efficient Numerical Methods for Nonlinear MPC and Moving Horizon Estimation," Int. Workshop on Assessment and Future Directions of NMPC, 24 pages, Pavia, Italy, Sep. 5-9, 2008.

Ding, "Characterising Combustion in Diesel Engines, Using Parameterised Finite Stage Cylinder Process Models," 281 pages, Dec. 21, 2011.

Docquier et al., "Combustion Control and Sensors: a Review," Progress in Energy and Combustion Science, vol. 28, pp. 107-150, 2002.

Dunbar, "Model Predictive Control: Extension to Coordinated Multi-Vehicle Formations and Real-Time Implementation," CDS Technical Report 01-016, 64 pages, Dec. 7, 2001.

Egnell, "Combustion Diagnostics by Means of Multizone Heat Release Analysis and NO Calculation," SAE Technical Paper Series 981424, International Spring Fuels and Lubricants Meeting and Exposition, 22 pages, May 4-6, 1998.

Ericson, "NOx Modelling of a Complete Diesel Engine/SCR System," Licentiate Thesis, 57 pages, 2007.

Finesso et al., "Estimation of the Engine-Out NO2/NOx Ration in a Euro VI Diesel Engine," SAE International 2013-01-0317, 15 pages, Apr. 8, 2013.

Fleming, "Overview of Automotive Sensors," IEEE Sensors Journal, vol. 1, No. 4, pp. 296-308, Dec. 2001.

Ford Motor Company, "2012 My OBD System Operation Summary for 6.7L Diesel Engines," 149 pages, Apr. 21, 2011.

Formentin et al., "NOx Estimation in Diesel Engines via In-Cylinder Pressure Measurement," IEEE Transactions on Control Systems Technology, vol. 22, No. 1, pp. 396-403, Jan. 2014.

(56) References Cited

OTHER PUBLICATIONS

Galindo, "An On-Engine Method for Dynamic Characterisation of NOx Concentration Sensors," Experimental Thermal and Fluid Science, vol. 35, pp. 470-476, 2011.
Gamma Technologies, "Exhaust Aftertreatment with GT-Suite," 2 pages, Jul. 17, 2014.
GM "Advanced Diesel Technology and Emissions," powertrain technologies—engines, 2 pages, prior to Feb. 2, 2005.
Guardiola et al., "A Bias Correction Method for Fast Fuel-to-Air Ratio Estimation in Diesel Engines," Proceedings of the Institution of Mechanical Engineers, Part D: Journal of Automobile Engineering, vol. 227, No. 8, pp. 1099-1111, 2013.
Guardiola et al., "A Computationally Efficient Kalman Filter Based Estimator for Updating Look-Up Tables Applied to NOx Estimation in Diesel Engines," Control Engineering Practice, vol. 21, pp. 1455-1468.
Guerreiro et al., "Trajectory Tracking Nonlinear Model Predictive Control for Autonomous Surface Craft," Proceedings of the European Control Conference, Budapest, Hungary, 6 pages, Aug. 2009.
Guzzella et al., "Introduction to Modeling and Control of Internal Combustion Engine Systems," 303 pages, 2004.
Guzzella, et al., "Control of Diesel Engines," IEEE Control Systems Magazine, pp. 53-71, Oct. 1998.
Hahlin, "Single Cylinder ICE Exhaust Optimization," Master's Thesis, retrieved from https://pure.ltu.se/portal/files/44015424/LTU-EX-2013-43970821.pdf, 50 pages, Feb. 1, 2014.
Havelena, "Componentized Architecture for Advanced Process Management," Honeywell International, 42 pages, 2004.
Heywood, "Pollutant Formation and Control," Internal Combustion Engine Fundamentals, pp. 567-667, 1988.
Hiranuma, et al., "Development of DPF System for Commercial Vehicle—Basic Characteristic and Active Regeneration Performance," SAE Paper No. 2003-01-3182, Mar. 2003.
Hirsch et al., "Dynamic Engine Emission Models," Automotive Model Predictive Control, Chapter 5, 18 pages, LNCIS 402, 2012.
Hirsch et al., "Grey-Box Control Oriented Emissions Models," The International Federation of Automatic Control (IFAC), Proceedings of the 17th World Congress, pp. 8514-8519, Jul. 6-11, 2008.
Hockerdal, "EKF-based Adaptation of Look-Up Tables with an Air Mass-Flow Sensor Application," Control Engineering Practice, vol. 19, 12 pages, 2011.
Honeywell, "Profit Optimizer a Distributed Quadratic Program (DQP) Concepts Reference," 48 pages, prior to Feb. 2, 2005.
http://nexceris.com/news/nextech-materials/, "Nextech Materials is Now Nexceris," 7 pages, printed Oct. 4, 2016.
http://www.arb.ca.gov/msprog/obdprog/hdobdreg.htm, "Heavy-Duty OBD Regulations and Rulemaking," 8 pages, printed Oct. 4, 2016.
http://www.not2fast.wryday.com/turbo/glossary/turbo_glossary.shtml, "Not2Fast: Turbo Glossary," 22 pages, printed Oct. 1, 2004.
http://www.tai-cwv.com/sbl106.0.html, "Technical Overview—Advanced Control Solutions," 6 pages, printed Sep. 9, 2004.
https://www.dieselnet.com/standards/us/obd.php, "Emission Standards: USA: On-Board Diagnostics," 6 pages, printed Oct. 3, 2016.
Ishida et al., "An Analysis of the Added Water Effect on NO Formation in D.I. Diesel Engines," SAE Technical Paper Series 941691, International Off-Highway and Power-Plant Congress and Exposition, 13 pages, Sep. 12-14, 1994.
Ishida et al., "Prediction of NOx Reduction Rate Due to Port Water Injection in a DI Diesel Engine," SAE Technical Paper Series 972961, International Fall Fuels and Lubricants Meeting and Exposition, 13 pages, Oct. 13-16, 1997.
Jensen, "The 13 Monitors of an OBD System," http://www.oemoffhighway.com/article/1 0855512/the-13-monito . . . , 3 pages, printed Oct. 3, 2016.
Johansen et al., "Hardware Architecture Design for Explicit Model Predictive Control," Proceedings of ACC, 6 pages, 2006.
Johansen et al., "Hardware Synthesis of Explicit Model Predictive Controllers," IEEE Transactions on Control Systems Technology, vol. 15, No. 1, Jan. 2007.
Jonsson, "Fuel Optimized Predictive Following in Low Speed Conditions," Master's Thesis, 46 pages, Jun. 28, 2003.
Kelly, et al., "Reducing Soot Emissions from Diesel Engines Using One Atmosphere Uniform Glow Discharge Plasma," SAE Paper No. 2003-01-1183, Mar. 2003.
Keulen et al., "Predictive Cruise Control in Hybrid Electric Vehicles," World Electric Journal, vol. 3, ISSN 2032-6653, 11 pages, May 2009.
Khair et al., "Emission Formation in Diesel Engines," Downloaded from https://www.dieselnet.com/tech/diesel.emiform.php, 33 pages, printed Oct. 14, 2016.
Kihas et al., "Chapter 14, Diesel Engine SCR Systems: Modeling Measurements and Control," Catalytic Reduction Technology (book), Part 1, Chapter 14, prior to Jan. 29, 2016.
Kolmanovsky et al., "Issues in Modeling and Control of Intake Flow in Variable Geometry Turbocharged Engines", 18th IFIP Conf. System Modeling and Optimization, pp. 436-445, Jul. 1997.
Krause et al., "Effect of Inlet Air Humidity and Temperature on Diesel Exhaust Emissions," SAE International Automotive Engineering Congress, 8 pages, Jan. 8-12, 1973.
Kulhavy et al. "Emerging Technologies for Enterprise Optimization in the Process Industries," Honeywell, 12 pages, Dec. 2000.
Lavoie et al., "Experimental and Theoretical Study of Nitric Oxide Formation in Internal Combustion Engines," Combustion Science and Technology, vol. 1, pp. 313-326, 1970.
Locker, et al., "Diesel Particulate Filter Operational Characterization," Coming Incorporated, 10 pages, prior to Feb. 2, 2005.
Lu, "Challenging Control Problems and Engineering Technologies in Enterprise Optimization," Honeywell Hi-Spec Solutions, 30 pages, Jun. 4-6, 2001.
Maciejowski, "Predictive Control with Constraints," Prentice Hall, Pearson Education Limited, 4 pages, 2002.
Manchur et al., "Time Resolution Effects on Accuracy of Real-Time NOx Emissions Measurements," SAE Technical Paper Series 2005-01-0674, 2005 SAE World Congress, 19 pages, Apr. 11-14, 2005.
Mariethoz et al., "Sensorless Explicit Model Predictive Control of the DC-DC Buck Converter with Inductor Current Limitation," IEEE Applied Power Electronics Conference and Exposition, pp. 1710-1715, 2008.
Marjanovic, "Towards a Simplified Infinite Horizon Model Predictive Controller," 6 pages, Proceedings of the 5th Asian Control Conference, 6 pages, Jul. 20-23, 2004.
Mehta, "The Application of Model Predictive Control to Active Automotive Suspensions," 56 pages, May 17, 1996.
Mohammadpour et al., "A Survey on Diagnostics Methods for Automotive Engines," 2011 American Control Conference, pp. 985-990, Jun. 29-Jul. 1, 2011.
Moore, "Living with Cooled-EGR Engines," Prevention Illustrated, 3 pages, Oct. 3, 2004.
Moos, "Catalysts as Sensors—A Promising Novel Approach in Automotive Exhaust Gas Aftertreatment," http://www.mdpi.com/1424-8220/10/7/6773htm, 10 pages, Jul. 13, 2010.
Murayama et al., "Speed Control of Vehicles with Variable Valve Lift Engine by Nonlinear MPC," ICROS-SICE International Joint Conference, pp. 4128-4133, 2009.
National Renewable Energy Laboratory (NREL), "Diesel Emissions Control- Sulfur Effects Project (DECSE) Summary of Reports," U.S. Department of Energy, 19 pages, Feb. 2002.
Olsen, "Analysis and Simulation of the Rate of Heat Release (ROHR) in Diesel Engines," MSc-Assignment, 105 pages, Jun. 2013.
Ortner et al., "MPC for a Diesel Engine Air Path Using an Explicit Approach for Constraint Systems," Proceedings of the 2006 IEEE Conference on Control Applications, Munich Germany, pp. 2760-2765, Oct. 4-6, 2006.
Ortner et al., "Predictive Control of a Diesel Engine Air Path," IEEE Transactions on Control Systems Technology, vol. 15, No. 3, pp. 449-456, May 2007.
Pannocchia et al., "Combined Design of Disturbance Model and Observer for Offset-Free Model Predictive Control," IEEE Transactions on Automatic Control, vol. 52, No. 6, 6 pages, 2007.

(56) References Cited

OTHER PUBLICATIONS

Patrinos et al., "A Global Piecewise Smooth Newton Method for Fast Large-Scale Model Predictive Control," Tech Report TR2010-02, National Technical University of Athens, 23 pages, 2010.
Payri et al., "Diesel NOx Modeling with a Reduction Mechanism for the Initial NOx Coming from EGR or Re-Entrained Burned Gases," 2008 World Congress, SAE Technical Paper Series 2008-01-1188, 13 pages, Apr. 14-17, 2008.
Payri et al., "Methodology for Design and Calibration of a Drift Compensation Method for Fuel-to-Air Ratio," SAE International 2012-01-0717, 13 pages, Apr. 16, 2012.
Pipho et al., "NO2 Formation in a Diesel Engine," SAE Technical Paper Series 910231, International Congress and Exposition, 15 pages, Feb. 25-Mar. 1, 1991.
Qin et al., "A Survey of Industrial Model Predictive Control Technology," Control Engineering Practice, 11, pp. 733-764, 2003.
Querel et al., "Control of an SCR System Using a Virtual NOx Sensor," 7th IFAC Symposium on Advances in Automotive Control, The International Federation of Automotive Control, pp. 9-14, Sep. 4-7, 2013.
Rajamani, "Data-based Techniques to Improve State Estimation in Model Predictive Control," PhD. Dissertation, 257 pages, 2007.
Rawlings, "Tutorial Overview of Model Predictive Control," IEEE Control Systems Magazine, pp. 38-52, Jun. 2000.
Ricardo Software, "Powertrain Design at Your Fingertips," retrieved from http://www.ricardo.com/PageFiles/864/WaveFlyerA4_4PP.pdf, 2 pages, downloaded Jul. 27, 2015.
Salvat, et al., "Passenger Car Serial Application of a Particulate Filter System on a Common Rail Direct Injection Engine," SAE Paper No. 2000-01-0473, 14 pages, Feb. 2000.
Santin et al., "Combined Gradient/Newton Projection Semi-Explicit QP Solver for Problems with Bound Constraints," 2 pages, prior to Jan. 29, 2016.
Schauffele et al., "Automotive Software Engineering Principles, Processes, Methods, and Tools," SAE International, 10 pages, 2005.
Schilling et al., "A Real-Time Model for the Prediction of the NOx Emissions in DI Diesel Engines," Proceedings of the 2006 IEEE International Conference on Control Applications, pp. 2042-2047, Oct. 4-7, 2006.
Schilling, "Model-Based Detection and Isolation of Faults in the Air and Fuel Paths of Common-Rail DI Diesel Engines Equipped with a Lambda and a Nitrogen Oxides Sensor," Doctor of Sciences Dissertation, 210 pages, 2008.
Shahzad et al., "Preconditioners for Inexact Interior Point Methods for Predictive Control," 2010 American Control Conference, pp. 5714-5719, Jun. 30-Jul. 2010.
Shamma, et al. "Approximate Set-Valued Observers for Nonlinear Systems," IEEE Transactions on Automatic Control, vol. 42, No. 5, May 1997.
Signer et al., "European Programme on Emissions, Fuels and Engine Technologies (EPEFE)—Heavy Duty Diesel Study," International Spring Fuels and Lubricants Meeting, SAE 961074, May 6-8, 1996.
Soltis, "Current Status of NOx Sensor Development," Workshop on Sensor Needs and Requirements for PEM Fuel Cell Systems and Direct-Injection Engines, 9 pages, Jan. 25-26, 2000.
Stefanopoulou, et al., "Control of Variable Geometry Turbocharged Diesel Engines for Reduced Emissions," IEEE Transactions on Control Systems Technology, vol. 8, No. 4, pp. 733-745, Jul. 2000.
Stewart et al., "A Model Predictive Control Framework for Industrial Turbodiesel Engine Control," Proceedings of the 47th IEEE Conference on Decision and Control, 8 pages, 2008.
Stewart et al., "A Modular Model Predictive Controller for Turbodiesel Problems," First Workshop on Automotive Model Predictive Control, Schloss Muhldorf, Feldkirchen, Johannes Kepler University, Linz, 3 pages, 2009.
Storset et al., "Air Charge Estimation for Turbocharged Diesel Engines," vol. 1 Proceedings of the American Control conference, 8 pages, Jun. 28-30, 2000.
Stradling et al., "The Influene of Fuel Properties and Injection Timing on the Exhaust Emissions and Fuel Consumption of an Iveco Heavy-Duty Diesel Engine," International Spring Fuels and Lubricants Meeting, SAE 971635, May 5-8, 1997.
Takacs et al., "Newton-Raphson Based Efficient Model Predictive Control Applied on Active Vibrating Structures," Proceeding of the European Control Conference 2009, Budapest, Hungary, pp. 2845-2850, Aug. 23-26, 2009.
The MathWorks, "Model-Based Calibration Toolbox 2.1 Calibrate complex powertrain systems," 4 pages, prior to Feb. 2, 2005.
The MathWorks, "Model-Based Calibration Toolbox 2.1.2," 2 pages, prior to Feb. 2, 2005.
Theiss, "Advanced Reciprocating Engine System (ARES) Activities at the Oak Ridge National Lab (ORNL), Oak Ridge National Laboratory," U.S. Department of Energy, 13 pages, Apr. 14, 2004.
Tondel et al., "An Algorithm for Multi-Parametric Quadratic Programming and Explicit MPC Solutions," Automatica, 39, pp. 489-497, 2003.
Traver et al., "A Neural Network-Based Virtual NOx Sensor for Diesel Engines," 7 pages, prior to Jan. 29, 2016.
Tschanz et al., "Cascaded Multivariable Control of the Combustion in Diesel Engines," The International Federation of Automatic Control (IFAC), 2012 Workshop on Engine and Powertrain Control, Simulation and Modeling, pp. 25-32, Oct. 23-25, 2012.
Tschanz et al., "Control of Diesel Engines Using NOx-Emission Feedback," International Journal of Engine Research, vol. 14, No. 1, pp. 45-56, 2013.
Tschanz et al., "Feedback Control of Particulate Matter and Nitrogen Oxide Emissions in Diesel Engines," Control Engineering Practice, vol. 21, pp. 1809-1820, 2013.
Turner, "Automotive Sensors, Sensor Technology Series," Momentum Press, Unable to Obtain the Entire Book, the Front and Back Covers and Table of Contents are Provided, 2009.
Van Basshuysen et al., "Lexikon Motorentechnik," (Dictionary of Automotive Technology) published by Vieweg Verlag, Wiesbaden 039936, p. 518, 2004. (English Translation).
Van Den Boom et al., "MPC for Max-Plus-Linear Systems: Closed-Loop Behavior and Tuning," Proceedings of the 2001 American Control Conference, Arlington, Va, pp. 325-330, Jun. 2001.
Van Heiden et al., "Optimization of Urea SCR deNOx Systems for HD Diesel Engines," SAE International 2004-01-0154, 13 pages, 2004.
Van Keulen et al., "Predictive Cruise Control in Hybrid Electric Vehicles," World Electric Vehicle Journal vol. 3, ISSN 2032-6653, pp. 1-11, 2009.
Vdo, "UniNOx-Sensor Specification," Continental Trading GmbH, 2 pages, Aug. 2007.
Vereschaga et al., "Piecewise Affine Modeling of NOx Emission Produced by a Diesel Engine," 2013 European Control Conference (ECC), pp. 2000-2005, Jul. 17-19, 2013.
Wahlstrom et al., "Modelling Diesel Engines with a Variable-Geometry Turbocharger and Exhaust Gas Recirculation by Optimization of Model Parameters for Capturing Non-Linear System Dynamics," (Original Publication) Proceedings of the Institution of Mechanical Engineers, Part D, Journal of Automobile Engineering, vol. 225, No. 7, 28 pages, 2011.
Wang et al., "Fast Model Predictive Control Using Online Optimization," Proceedings of the 17th World Congress, the International Federation of Automatic Control, Seoul, Korea, pp. 6974-6979, Jul. 6-11, 2008.
Wang et al., "PSO-Based Model Predictive Control for Nonlinear Processes," Advances in Natural Computation, Lecture Notes in Computer Science, vol. 3611/2005, 8 pages, 2005.
Wang et al., "Sensing Exhaust NO2 Emissions Using the Mixed Potential Principal," SAE 2014-01-1487, 7 pages, Apr. 1, 2014.
Wilhelmsson et al., "A Fast Physical NOx Model Implemented on an Embedded System," Proceedings of the IFAC Workshop on Engine and Powertrain Control, Simulation and Modeling, pp. 207-215, Nov. 30-Dec. 2, 2009.
Wilhemsson et al., "A Physical Two-Zone NOx Model Intended for Embedded Implementation," SAE 2009-01-1509, 11 pages, 2009.

(56) References Cited

OTHER PUBLICATIONS

Winkler et al., "Incorporating Physical Knowledge About the Formation of Nitric Oxides into Evolutionary System Identification," Proceedings of the 20th European Modeling and Simulation Symposium (EMSS), 6 pages, 2008.
Winkler et al., "On-Line Modeling Based on Genetic Programming," 12 pages, International Journal on Intelligent Systems Technologies and Applications 2, 2007.
Winkler et al., "Using Genetic Programming in Nonlinear Model Identification," 99 pages, prior to Jan. 29, 2016.
Winkler et al., "Virtual Sensors for Emissions of a Diesel Engine Produced by Evolutionary System Identification," LNCS, vol. 5717, 8 pages, 2009.
Wong, "CARB Heavy-Duty OBD Update," California Air Resources Board, SAE OBD TOPTEC, Downloaded from http://www.arb.ca.gov/msprog/obdprog/hdobdreg.htm, 72 pages, Sep. 15, 2005.
Wright, "Applying New Optimization Algorithms to Model Predictive Control," 5th International Conference on Chemical Process Control, 10 pages, 1997.
Yao et al., "The Use of Tunnel Concentration Profile Data to Determine the Ratio of NO2/NOx Directly Emitted from Vehicles," HAL Archives, 19 pages, 2005.
Zavala et al., "The Advance-Step NMPC Controller: Optimality, Stability, and Robustness," Automatica, vol. 45, pp. 86-93, 2009.
Zeilinger et al., "Real-Time MPC—Stability Through Robust MPC Design," Joint 48th IEEE Conference on Decision and Control and 28th Chinese Control Conference, Shanghai, P.R. China, pp. 3980-3986, Dec. 16-18, 2009.
Zeldovich, "The Oxidation of Nitrogen in Combustion and Explosions," ACTA Physiochimica U.R.S.S., vol. XX1, No. 4, 53 pages, 1946.
Zelenka, et al., "An Active Regeneration as a Key Element for Safe Particulate Trap Use," SAE Paper No. 2001-0103199, 13 pages, Feb. 2001.
Zhu, "Constrained Nonlinear Model Predictive Control for Vehicle Regulation," Dissertation, Graduate School of the Ohio State University, 125 pages, 2008.
Zhuiykov et al., "Development of Zirconia-Based Potentiometric NOx Sensors for Automotive and Energy Industries in the Early 21st Century: What are the Prospects for Sensors?", Sensors and Actuators B, vol. 121, pp. 639-651, 2007.
Desantes et al., "Development of NOx Fast Estimate Using NOx Sensor," EAEC 2011 Congress, 2011. Unable to Obtain a Copy of This Reference.
Andersson et al., "Fast Physical NOx Prediction in Diesel Engines, The Diesel Engine: The Low CO2 and Emissions Reduction Challenge," Conference Proceedings, Lyon, 2006. Unable to Obtain a Copy of This Reference.
Winkler, "Evolutionary System Identification—Modern Approaches and Practical Applications," Kepler Universitat Linz, Reihe C: Technik and Naturwissenschaften, Universitatsverlag Rudolf Trauner, 2009. Unable to Obtain a Copy of This Reference.
Smith, "Demonstration of a Fast Response On-Board NOx Sensor for Heavy-Duty Diesel Vehicles," Technical report, Southwest Research Institute Engine and Vehicle Research Division SwRI Project No. 03-02256 Contract No. 98-302, 2000. Unable to Obtain a Copy of This Reference.
"J1979 E/E Diagnostic Test Modules," Proposed Regulation, Vehicle E.E. System Diagnostic Standards Committee, 1 page, Sep. 28, 2010.
"MicroZed Zynq Evaluation and Development and System on Module, Hardware User Guide," Avnet Electronics Marketing, Version 1.6, Jan. 22, 2015.
Actron, "Elite AutoScanner Kit—Enhanced OBD I & II Scan Tool, OBD 1300," Downloaded from https://actron.com/content/elite-autoscanner-kit-enhanced-obd-i-and-obd-ii-scan-tool?utm_ . . . , 5 pages, printed Sep. 27, 2016.
Blue Streak Electronics Inc., "Ford Modules," 1 page, May 12, 2010.
Goodwin, "Researchers Hack a Corvette's Brakes via Insurance Black Box," Downloaded from http://www.cnet.com/roadshow/news/researchers-hack-a-corvettes-brakes-via-insurance-black-box/, 2 pages, Aug. 2015.
Greenberg, "Hackers Remotely Kill a Jeep on the Highway—With Me in It," Downloaded from http://www.wired.com/2015/07/hackers-remotely-kill-jeep-highway/, 24 pages, Jul. 21, 2015.
Hammacher Schlemmer, "The Windshield Heads Up Display," Catalog, p. 47, prior to Apr. 26, 2016.
https://www.en.wikipedia.org/wiki/Public-key_cryptography, "Public-Key Cryptography," 14 pages, printed Feb. 26, 2016.
Zaman, "Lincoln Motor Company: Case study 2015 Lincoln MKC," Automotive Electronic Design Fundamentals, Chapter 6, 2015.
"Aftertreatment Modeling of RCCI Engine During Transient Operation," University of Wisconsin—Engine Research Center, 1 page, May 31, 2014.
"Chapter 14: Pollutant Formation," Fluent Manual, Release 15.0, Chapter 14, pp. 313-345, prior to Jan. 29, 2016.
"Chapter 21, Modeling Pollutant Formation," Fluent Manual, Release 12.0, Chapter 21, pp. 21-1-21-54, Jan. 30, 2009.
"Model Predictive Control Toolbox Release Notes," The Mathworks, 24 pages, Oct. 2008.
"Model Predictive Control," Wikipedia, pp. 1-5, Jan. 22, 2009. http://en.wikipedia.org/w/index.php/title=Special:Book&bookcmd=download&collecton_id=641cd1b5da77cc22&writer=rl&retum_to=Model predictive control, retrieved Nov. 20, 2012.
"MPC Implementation Methods for the Optimization of the Response of Control Valves to Reduce Variability," Advanced Application Note 002, Rev.A, 10 pages, 2007.
"SCR, 400-csi Coated Catalyst," Leading NOx Control Technologies Status Summary, 1 page prior to Feb. 2, 2005.
Advanced Petroleum-Based Fuels-Diesel Emissions Control (APBF-DEC) Project, "Quarterly Update," No. 7, 6 pages, Fall 2002.
Allanson, et al., "Optimizing the Low Temperature Performance and Regeneration Efficiency of the Continuously Regenerating Diesel Particulate Filter System," SAE Paper No. 2002-01-0428, 8 pages, Mar. 2002.
Amstuz, et al., "EGO Sensor Based Robust Output Control of EGR in Diesel Engines," IEEE TCST, vol. 3, No. 1, 12 pages, Mar. 1995.
Andersson et al., "A Predictive Real Time NOx Model for Conventional and Partially Premixed Diesel Combustion," SAE International 2006-01-3329, 10 pages, 2006.
Andersson et al., "A Real Time NOx Model for Conventional and Partially Premixed Diesel Combustion," SAE Technical Paper Series 2006-01-0195, 2006 SAE World Congress, 13 pages, Apr. 3-6, 2006.
Arregle et al., "On Board NOx Prediction in Diesel Engines: A Physical Approach," Automotive Model Predictive Control, Models Methods and Applications, Chapter 2, 14 pages, 2010.
Asprion, "Optimal Control of Diesel Engines," PHD Thesis, Diss ETH No. 21593, 436 pages, 2013.
Assanis et al., "A Predictive Ignition Delay Correlation Under Steady-State and Transient Operation of a Direct Injection Diesel Engine," ASME, Journal of Engineering for Gas Turbines and Power, vol. 125, pp. 450-457, Apr. 2003.
Axehill et al., "A Dual Gradiant Projection Quadratic Programming Algorithm Tailored for Model Predictive Control," Proceedings of the 47th IEEE Conference on Decision and Control, Cancun Mexico, pp. 3057-3064, Dec. 9-11, 2008.
Axehill et al., "A Dual Gradient Projection Quadratic Programming Algorithm Tailored for Mixed Integer Predictive Control," Technical Report from Linkopings Universitet, Report No. Li—Th—ISY-R-2833, 58 pages, Jan. 31, 2008.
Baffi et al., "Non-Linear Model Based Predictive Control Through Dynamic Non-Linear Partial Least Squares," Trans IChemE, vol. 80, Part A, pp. 75-86, Jan. 2002.
Bako et al., "A Recursive Identification Algorithm for Switched Linear/Affine Models," Nonlinear Analysis: Hybrid Systems, vol. 5, pp. 242-253, 2011.

(56) References Cited

OTHER PUBLICATIONS

Barba et al., "A Phenomenological Combustion Model for Heat Release Rate Prediction in High-Speed DI Diesel Engines with Common Rail Injection," SAE Technical Paper Series 2000-01-2933, International Fall Fuels and Lubricants Meeting Exposition, 15 pages, Oct. 16-19, 2000.
Bemporad et al., "Model Predictive Control Toolbox 3, User's Guide," Matlab Mathworks, 282 pages, 2008.
Bemporad et al., "The Explicit Linear Quadratic Regulator for Constrained Systems," Automatica, 38, pp. 3-20, 2002.
Bemporad, "Model Predictive Control Based on Linear Programming—The Explicit Solution," IEEE Transactions on Automatic Control, vol. 47, No. 12, pp. 1974-1984, Dec. 2002.
Bemporad, "Model Predictive Control Design: New Trends and Tools," Proceedings of the 45th IEEE Conference on Decision & Control, pp. 6678-6683, Dec. 13-15, 2006.
Bemporad, et al., "Explicit Model Predictive Control," 1 page, prior to Feb. 2, 2005.
Bertsekas, "On the Goldstein-Levitin-Polyak Gradient Projection Method," IEEE Transactions on Automatic Control, vol. AC-21, No. 2, pp. 174-184, Apr. 1976.
Bertsekas, "Projected Newton Methods for Optimization Problems with Simple Constraints*," SIAM J. Control and Optimization, vol. 20, No. 2, pp. 221-246, Mar. 1982.
Blanco-Rodriguez, "Modelling and Observation of Exhaust Gas Concentrations for Diesel Engine Control," Phd Dissertation, 242 pages, Sep. 2013.
Borrelli et al., "An MPC/Hybrid System Approach to Traction Control," IEEE Transactions on Control Systems Technology, vol. 14, No. 3, pp. 541-553, May 2006.
Borrelli, "Constrained Optimal Control of Linear and Hybrid Systems," Lecture Notes in Control and Information Sciences, vol. 290, 2003.
Borrelli, "Discrete Time Constrained Optimal Control," A Dissertation Submitted to the Swiss Federal Institute of Technology (ETH) Zurich, Diss. ETH No. 14666, 232 pages, Oct. 9, 2002.
Bourn et al., "Advanced Compressor Engine Controls to Enhance Operation, Reliability and Integrity," Southwest Research Institute, DOE Award No. DE-FC26-03NT41859, SwRI Project No. 03.10198, 60 pages, Mar. 2004.
Catalytica Energy Systems, "Innovative NOx Reduction Solutions for Diesel Engines," 13 pages, 3rd Quarter, 2003.
Charalampidis et al., "Computationally Efficient Kalman Filtering for a Class of Nonlinear Systems," IEEE Transactions on Automatic Control, vol. 56, No. 3, pp. 483-491, Mar. 2011.
Chatterjee, et al. "Catalytic Emission Control for Heavy Duty Diesel Engines," JM, 46 pages, prior to Feb. 2, 2005.
Chew, "Sensor Validation Scheme with Virtual NOx Sensing for Heavy Duty Diesel Engines," Master's Thesis, 144 pages, 2007.
European Search Report for EP Application No. 11167549.2 dated Nov. 27, 2012.
European Search Report for EP Application No. 12191156.4-1603 dated Feb. 9, 2015.
European Search Report for EP Application No. EP 10175270.7-2302419 dated Jan. 16, 2013.
European Search Report for EP Application No. EP 15152957.5-1807 dated Feb. 10, 2015.
The Extended European Search Report for EP Application No. 15155295.7-1606, dated Aug. 4, 2015.
The Extended European Search Report for EP Application No. 15179435.1, dated Apr. 1, 2016.
U.S. Appl. No. 15/011,445, filed Jan. 29, 2016.
De Oliveira, "Constraint Handling and Stability Properties of Model Predictive Control," Carnegie Institute of Technology, Department of Chemical Engineering, Paper 197, 64 pages, Jan. 1, 1993.
De Schutter et al., "Model Predictive Control for Max-Min-Plus-Scaling Systems," Proceedings of the 2001 American Control Conference, Arlington, Va, pp. 319-324, Jun. 2001.
Extended European Search Report for EP Application No. 17163452.0, dated Sep. 26, 2017.
Extended European Search Report for EP Application No. 17151521.6, dated Oct. 23, 2017.
Greenberg, "Hackers Cut a Corvette's Brakes Via A Common Car Gadget," downloaded from https://www.wired.com2015/08/hackers-cut-corvettes-brakes-v..., 14 pages, Aug. 11, 2015, printed Dec. 11, 2017.
http://www.blackpoolc,ommunications.com/products/alarm-immo..., "OBD Security OBD Port Protection—Alarms & Immobilizers . . .," 1 page, printed Jun. 5, 2017.
http://www.cnbc.com/2016/09/20/chinese-company-hacks-tesla-car-remotely.html, "Chinese Company Hacks Tesla Car Remotely," 3 pages, Sep. 20, 2016.
ISO, "ISO Document No. 13185-2:2015(E)," 3 pages, 2015.

* cited by examiner

CONDITION-BASED POWERTRAIN CONTROL SYSTEM

BACKGROUND

The present disclosure pertains to powertrain systems, and particularly to a control of engines and cooling systems. More particularly, the disclosure pertains to performance improvement of engines and cooling systems.

SUMMARY

The disclosure reveals a system and approach for development of set points and set point trajectories for a controller of a powertrain system. A controller of the powertrain system may be configured to determine set points and/or set point trajectories for one or more conditions of the powertrain system. The controller may determine set points and/or set point trajectories for the one or more conditions of the powertrain system based, at least in part, on current operating conditions of the powertrain system and performance cost function. The controller may determine positions of actuators of the powertrain system to drive the conditions of the powertrain system to the determined set points and/or set point trajectories. The present system and approach may configure and update set points and set point trajectories for conditions of a powertrain system in real time and while the powertrain system is operating.

The approach described in this disclosure may be important for controlling transient performance of powertrain systems and/or be important for other purposes. This may be so because a standard approach for controlling performance of powertrain systems may consist of computing static offline set points as a function of disturbance variables, and for transient performance optimization, such an approach may require maps having large dimensions that may exceed memory available in the engine control unit and/or processing power thereof that may be present in an online environment. However, the disclosed system and approach may determine set points and/or set point trajectories online and in real time with less memory and processing power requirements than conventional approaches.

DESCRIPTION

Figure 1:
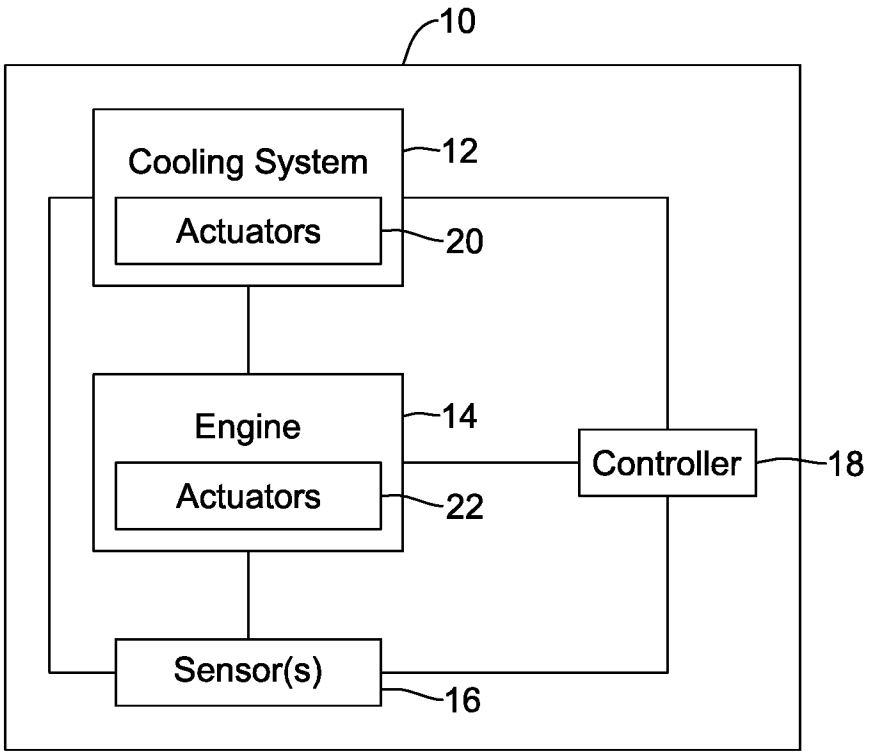
FIG. 1 is a schematic block diagram of an illustrative powertrain system.

The present system and approach, as described herein and/or shown in the Figures, may incorporate one or more processors, computers, controllers, user interfaces, wireless and/or wire connections, and/or the like, wherever desired.

Transportation original equipment manufacturers (OEMs) may spend a large amount of time and money on a labor intensive process of designing setpoints for their powertrain controllers. A powertrain may incorporate an engine, a cooling system, and, in some instances, an exhaust gas aftertreatment mechanism. The powertrain may also incorporate a drivetrain and, in some setups, a vehicle associated with the drivetrain. Any reference to an engine, cooling system, powertrain or aftertreatment system herein, may be regarded as a reference to any other or all of these components.

One version of the present approach may leverage a powertrain controller to assist in the development of set points and/or set point trajectories for conditions of the powertrain system. The powertrain controller may be parametrized as a function of the set point trajectories to set actuator positions in real time (e.g., while the powertrain system is operating). Another version of the present approach may be a practical way for providing a user with information about how best to modify setpoints for a powertrain controller on-line and in real time.

A characteristic of powertrain condition management systems (e.g., a powertrain thermal management system or other powertrain system) may be that operating conditions (e.g., speed, load, and so forth) may change continuously or off and on while the powertrain is operating to meet the needs of an operator of the powertrain. In an example of powertrain thermal management systems, optimal temperatures (e.g., temperature set point trajectories of components of a powertrain system) for minimum fuel consumption and/or actuator power consumption may depend on current operating conditions of the powertrain system. One approach may control temperature set point trajectories of components of the powertrain system such that the temperatures may be driven to optimal values (e.g., set point trajectories) for a given economic cost function of operating the powertrain (e.g., to minimize fuel costs, energy consumption, and so on). In some cases, the economic cost function may take into consideration performance variables such as fuel consumption, energy consumption, parasitic losses, exhaust output, and so forth, when changes in operating conditions of the powertrain are measured or future changes to the operating condition may be available. Although the powertrain thermal management systems disclosed herein may be discussed primarily with respect to setting temperature set point trajectories, the disclosed concepts may be utilized with pressure set point trajectories (e.g., air-conditioning refrigerant), flow set point trajectories (e.g., coolant flow), and/or other condition set point trajectories of powertrain systems.

In some cases, set point trajectories for conditions of the powertrain may be maintained within one or more constraints. In one example, an economic cost function applied to the control of a powertrain system may be part of a model-predictive control (MPC) framework such that a control action may be generated while maintaining one or more conditions (e.g., a temperature condition, actuator positions, and so forth) within one or more constraints.

Although control strategies for set point trajectory regulation with set point trajectories from steady state optimization (e.g., off-line optimization) may be used; such control strategies may not provide optimal performance of the powertrain system because the set point trajectories may be set without taking into consideration current operating conditions of the powertrain system. In some cases, thermal management of a powertrain system may be investigated from a system modeling and/or optimization perspective, where the optimization of the powertrain system performance occurs on-line (e.g., in real time during operation of an engine or other component of the powertrain system).

Herein, one may discuss approaches and/or systems for optimization (e.g., on-line optimization) of powertrain thermal management in a model-based control framework. As discussed further below, the disclosed concepts may be implemented in one or more of two or more approaches which each address on-line optimization and control of powertrain thermal management.

Turning to the figures, FIG. 1 depicts a powertrain system 10. The powertrain system 10 may include a cooling system 12, an engine 14, sensors 16, a controller 18, and/or one or more other components.

The cooling system 12 may be connected to the engine 14. Illustratively, the cooling system 12 may be configured to manage temperature values of powertrain components, including the engine 14.

One or more sensors 16 of the powertrain system 10 may be configured to sense one or more variables of the cooling system 12 and/or the engine 14. In some cases, the sensors 16 may be in communication with the controller 18 and configured to send sensed variable values to the controller 18.

The sensors 16 may be any type of sensor configured to sense a variable of the powertrain system. For example, the sensors 16 may include, but are not limited to, a temperature sensor, an absolute pressure sensor, a gage pressure sensor, a differential pressure sensor, a flow sensor, a position sensor, and/or one or more other types of sensors.

The controller 18 may be an electronic control module (ECM) or electronic control unit (ECU) with a control system algorithm therein. In one example, the control system algorithm may configure the controller 18 to be a multi-variable controller.

Figure 2:
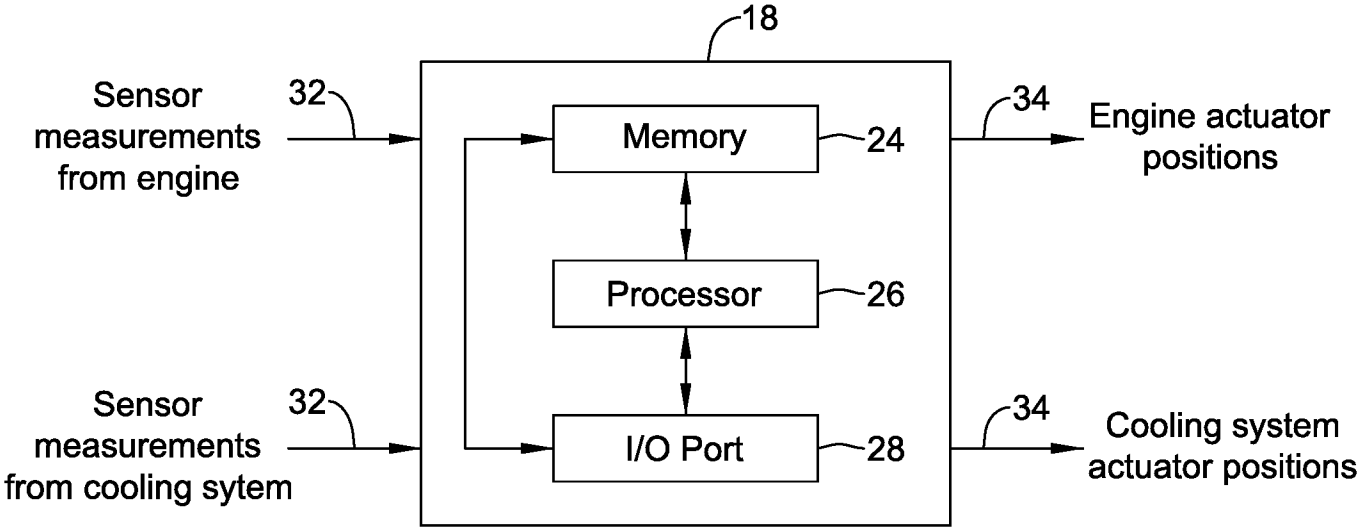
FIG. 2 is a schematic block diagram of a controller of the illustration powertrain system.

As seen in FIG. 2, the controller 18 may include one or more controller components having memory 24, a processor 26, an input/output (I/O) port 28, and/or one or more other components. The processor 26 may be in communication with the memory 24 and may be configured to execute executable instructions stored on the memory 24 and/or store and use data saved on the memory 24. In one example, the memory 24 may include one or more control system algorithms and/or other algorithms and the processor 26 may execute instructions (e.g., software code or other instructions) related to the algorithms in the memory 24.

The memory 24 may be any type of memory and/or may include any combination of types of memory. For example, the memory may be volatile memory, non-volatile memory, random access memory (RAM), FLASH, read-only memory (ROM), and/or one or more other types of memory.

The I/O port 28 may send and/or receive information and/or control signals to and/or from the cooling system 12, engine 14, one or more sensors 16, actuators, 20, 22, and/or other components of the power system 10 or components interacting with the power system 10. The I/O port 28 may be configured to communicate over a wired or wireless connection with other communicative components. Example wireless connections may include, but are not limited to, near-field communication (NFC), Wi-Fi, local area networks (LAN), wide area networks (WAN), Bluetooth®, Bluetooth® Low Energy (BLE), ZIGBEE, and/or one or more other non-proprietary or proprietary wireless connection.

In some cases, the controller 18 may be configured to control positions of actuators of the powertrain system 10 by outputting control signals 34 (e.g., control signals for setting actuator positions), as shown in FIG. 2, from the I/O port 28 or other port to drive conditions of powertrain system 10 components to an associated set point trajectory. The outputted control signals 34 may be based, at least in part on received values for one or more variables (e.g., sensor measurements 32 from components of the powertrain system 10 and/or other operating conditions, including actuator positions, of the powertrain system 10).

In one example controller 18, the controller 18 may be configured to control positions of actuators 20 of the cooling system 12, actuators 22 of the engine 14, and/or actuators of other components of the powertrain system 10 based at least in part, on receive values (e.g., from sensor measurements 32) of one or more variables. Example powertrain system 10 actuators include, but are not limited to, actuators of grill shutters, three-way valves, radiator fans, an engine pump, a turbocharger waste gage (WG), a variable geometry turbocharger (VGT), an exhaust gas recirculation (EGR) system, a start of injection (SOI) system, a throttle valve (TV), and so on. In some cases, sensors 16 may be configured to sense positions of the actuators.

As discussed and seen in FIG. 2, the controller 18 may be configured to receive values for one or more variables sensed by the sensors 16. Variables sensed by the sensors 16 may include one or more of engine in-cylinder wall temperature (e.g., temperature of a metal or other material of an engine), $T_{metal}$, intake air temperature, $T_{intake\ air}$, engine oil temperature, $T_{engine\ oil}$, three-way valve position, grill shutter position, radiator fan position, engine pump position, engine speed, engine load, vehicle speed, and/or one or more other variables related to operation of the powertrain system 10.

The values of sensed variables (e.g., of sensor measurement signals 32) received at the controller 18 from the one or more sensors 16 may be indicative of one or more conditions of the cooling system 12 and/or the engine 14. The received variable values may be a condition of the cooling system 12 and/or the engine 14 or may be used in calculating or determining a condition of the cooling system 12 and/or the engine 14. Illustrative conditions of the cooling system 12 and/or the engine 14 may include temperature conditions, pressure conditions, flow conditions, and/or one or more other conditions.

The controller 18 may be configured to set and/or propose set point trajectories for conditions of the cooling system 12 and/or the engine 14. Once set point trajectories for conditions of the cooling system 12 and/or the engine 14 are determined, the controller 18 may be configured to adjust one or more positions of the actuators 20 of the cooling system 12 and/or actuators 22 of the engine 14 to drive a value of the one or more conditions to associated condition set point trajectories. Determining the set point trajectories and/or adjusting the actuators may be performed while the controller is on-line (e.g., the cooling system 12 and/or the engine 14 are operating (e.g., during steady state and/or transient operation of the powertrain system 10) and the controller may be receiving inputs from sensors 16) and/or other inputs in real-time.

As referred to above, condition set point trajectories for conditions of the cooling system 12 and/or the engine 14 may be determined in one or more manners. In one example, set point trajectories for conditions of the cooling system 12 and/or the engine 14 may be determined based on experience (e.g., testing) and/or modeling the cooling system 12 and the engine 14. Then, once data has been obtained from experience and/or modeling, set point trajectories for the conditions may be determined off-line and fixed for on-line consideration in setting positions of actuators of the powertrain system 10. Such a technique for determining set point trajectories does not necessarily take into consideration current operating conditions of the powertrain system 10.

Additionally, or alternatively, set point trajectories may be determined by the controller 18 while taking into consideration current operating conditions of the powertrain system. When considering current operating conditions (e.g., steady state and/or transient operating conditions) of the powertrain system 10, a controller 18 may be configured to determine set point trajectories for one or more conditions of a powertrain system 10 (e.g., conditions of a cooling system 12, engine 14, and/or other components of the powertrain system) based, at least in part, on a cost function that may optimize a set of performance variables of the cooling system 12 and/or the engine 14. Illustrative optimization of performance variables may include, but are not limited to, minimizing fuel consumption, energy consumption, minimizing parasitic losses, and so forth. In one example use of a cost function, a controller 18 may utilize a cost function configured to determine set point trajectories for one or more thermal conditions (e.g., oil temperature, engine temperature, speed of a variable speed cooling pump, and so forth) to minimize fuel consumption.

A cost function utilized by the controller 18 may take into consideration a model of the powertrain system 10, where the model may be represented by:

$$\text{Cooling System/Engine Output: } x_dot=F(x,u,w),\quad \text{Outputs: } y=H(x,u,w) \tag{1}$$

"x" may represent variables for which on-engine sensor measurements may be taken (e.g., states of variables such as pressure, temperature, concentrations, turbo speed, and so on). "u" may represent manipulated variables or inputs (e.g., signals from the controller 18 to operate actuators such as a 3-way valve, grill shutters, radiator fans, an engine pump, and so forth). "w" may represent exogenous inputs such as speed, fuel, ambient conditions, and so forth. These inputs may be measured. However, some outputs of the powertrain system 10 such as performance and quality variables may not necessarily be measured, but may be inferred, approximated by modeling, estimated by trials, calculated with algorithms, and other ways.

When considering a model of the cooling system 12 and/or the engine 14, such as equation (1), a non-linear cost function, for example, may take the following form:

$$\min_{u} \; J = f(y(u, w), w) \tag{2}$$

where f(y,u) may represent variables of the cooling system 12 and the engine 14 that may have an impact on fuel economy (e.g., fuel consumption, energy consumption, parasitic losses, and so on) of the powertrain system 10. A mechanism for computing the actuator positions, u, in real-time such that it may optimize the cost function, J, may occur on a controller that may compute optimal set point trajectories for low-level controllers as follows:

$$\min_{\{y_SP_1,\ldots y_SP_{N_p}\}} J = \sum_{k=1}^{N_p} \left( f(y_k, w_k) + \| \mathrm{y_SP}_k - \mathrm{y_SP}_{k-1} \|_2^{R_\Delta} + \| \varepsilon \|_2^{G} \right) \tag{3}$$

Subject to:

$$y_k = G(x_k, \mathrm{y_SP}_k, w_k)$$

$$y_{min} - \varepsilon \le y_k \le y_{max} + \varepsilon$$

where $\|y_SP_k - y_SP_{k-1}\|_2^{R_\Delta}$ may represent tuning of the controller 18, $\|\varepsilon\|_2^{G}$ may represent soft constraints on the model, and $y_k = G(x_k, y_SP_k, w_k)$ and $y_{min} - \varepsilon \le y_k \le y_{max} + \varepsilon_V$ may represent that the model is a closed-loop model. Here, k is a time index and $y_SP_k$ are the optimal set point trajectories computed by the controller.

At least in part because the model of the powertrain system 10 may be configured to output set point trajectories for the conditions of cooling system 12 and/or the engine 14, the cost function may determine set point trajectories for conditions of the cooling system 12 and/or the engine 14 in view of inputs from sensors 16 and/or other inputs, while minimizing costs and maintaining the set point trajectories and positions of actuators represented in the powertrain system model (e.g., equation (1)) within predetermined constraints. In one example, the controller 18 may be configured to determine thermal set point trajectories for the temperature of an engine housing, temperature of air in an engine intake manifold, temperature of air in an engine exhaust manifold, temperature of engine oil, temperature of transmission oil, and/or one or more other temperatures of components of the powertrain system 10. Additionally, or alternatively, set point trajectories may be determined for other conditions of the powertrain system 10, as desired. The controller 18 may be configured to update the set point trajectories of the conditions during operation of the cooling system 12 and/or engine 14 in view of received values for one or more variables sensed by the sensors 16 and/or other inputs.

Figure 3:
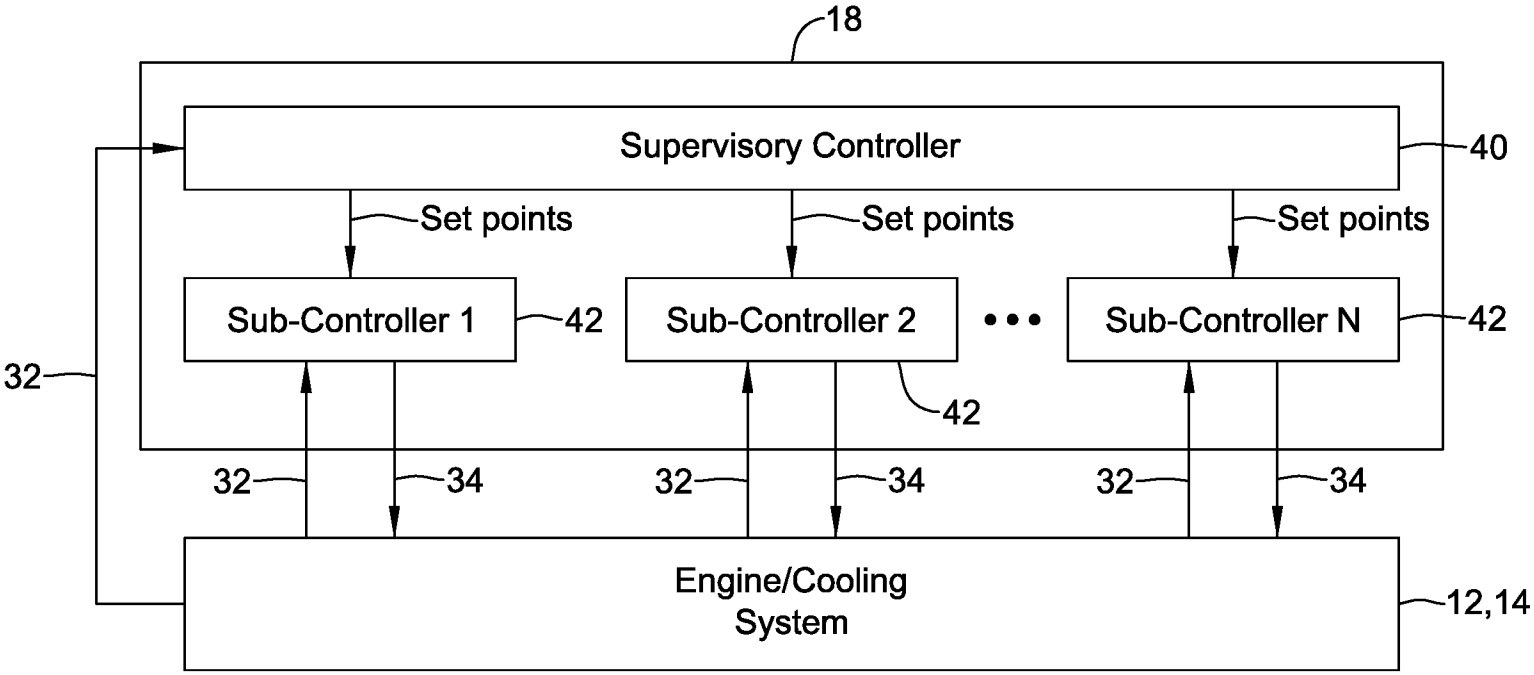
FIG. 3 is a schematic diagram of an implementation of an illustrative powertrain condition management system.

In some cases, the controller 18 (e.g., a multivariable controller based on Model. Predictive Control (MPC)) may be and/or may include a supervisory controller 40 in communication with two or more powertrain component sub-controllers 42, as shown in FIG. 3. The supervisory controller 40 may be configured to include the model (e.g., equation (1)) of the powertrain system 10 and the cost function (e.g., equation (2)) of the powertrain system 10 and determine set point trajectories for one or more condition of the cooling system 12 and the engine 14 (e.g., a set point trajectory for a temperature condition of the cooling system 12 and/or the engine 14). As shown in FIG. 3, determined set point trajectories for conditions may be sent from the supervisory controller 40 to a sub-controller 42.

The sub-controllers 42 may be any type of controller. In one example, one or more sub-controllers 42 may be multivariable MPC based controllers configured to optimize output for one or more set point trajectories determined by the supervisory controller 40 and/or one or more sub-controllers 42 may be proportional-integral-derivative (PID) controllers configured to optimize output for a single set point trajectory determined by the supervisory controller 40.

In one example, the MPC based sub-controllers 42 may determine positions of actuators 20, 22 based on the following incoming sensor measurements 32 and the following cost function:

$$\min_{\{u_1,\ldots u_{N_p}\}} J = \sum_{k=1}^{N_p} \left( \| y_k - y_k^{SP} \|_2^{Q} + \| u_k - u_k^{FF} \|_3^{R_R} + \| u_k - u_{k-1} \|_2^{R_\Delta} + \| \varepsilon \|_2^{G} \right) \tag{4}$$

subject to:

$$y_k = L(x_k, u_k, w_k) \tag{5}$$

$$u_{min} \le u_k \le u_{max}$$

$$y_{min} - \varepsilon \le y_k \le y_{max} + \varepsilon$$

Here, $y_k^{sp}$ may represent a variable for which a set point trajectory was determined by the supervisory controller 40 and $y_k$ may represent a value sensed by sensors 16 for the variable (e.g., condition) for which a set point trajectory is provided. As the MPC based sub-controller 42 may be a multivariable controller, the MPC may set values (e.g., positions) for one or more manipulated variables (e.g., positions of actuators 20, 22) to drive controlled variables (e.g., conditions) to associated set point trajectories (e.g., set point trajectories of conditions).

PID sub-controllers 42 may include a control loop feedback mechanism. In one example, the PID sub-controller 42 may calculate an error value as a difference between a measured variable and a set point trajectory for that variable, as determined by the supervisory controller 40. Over time, the PID sub-controller 42 may attempt to minimize the error by adjusting values (e.g., positions) of a manipulated variable (e.g., positions of an actuator 20, 22) to drive controlled variables (e.g., conditions) to associated set point trajectories (e.g., set point trajectories of conditions).

Once the positions of the actuators 20, 22 have been set by the sub-controllers 42 to meet the set point trajectories determined by the supervisory controller 40, the actuator positions may be sent to the cooling system 12 and/or the engine 14 and values of variables sensed by sensors 16 may be provided back to the supervisory controller 40 for use as inputs in the powertrain system cost function to determine set point trajectories of conditions and repeat the above steps.

Figure 4:
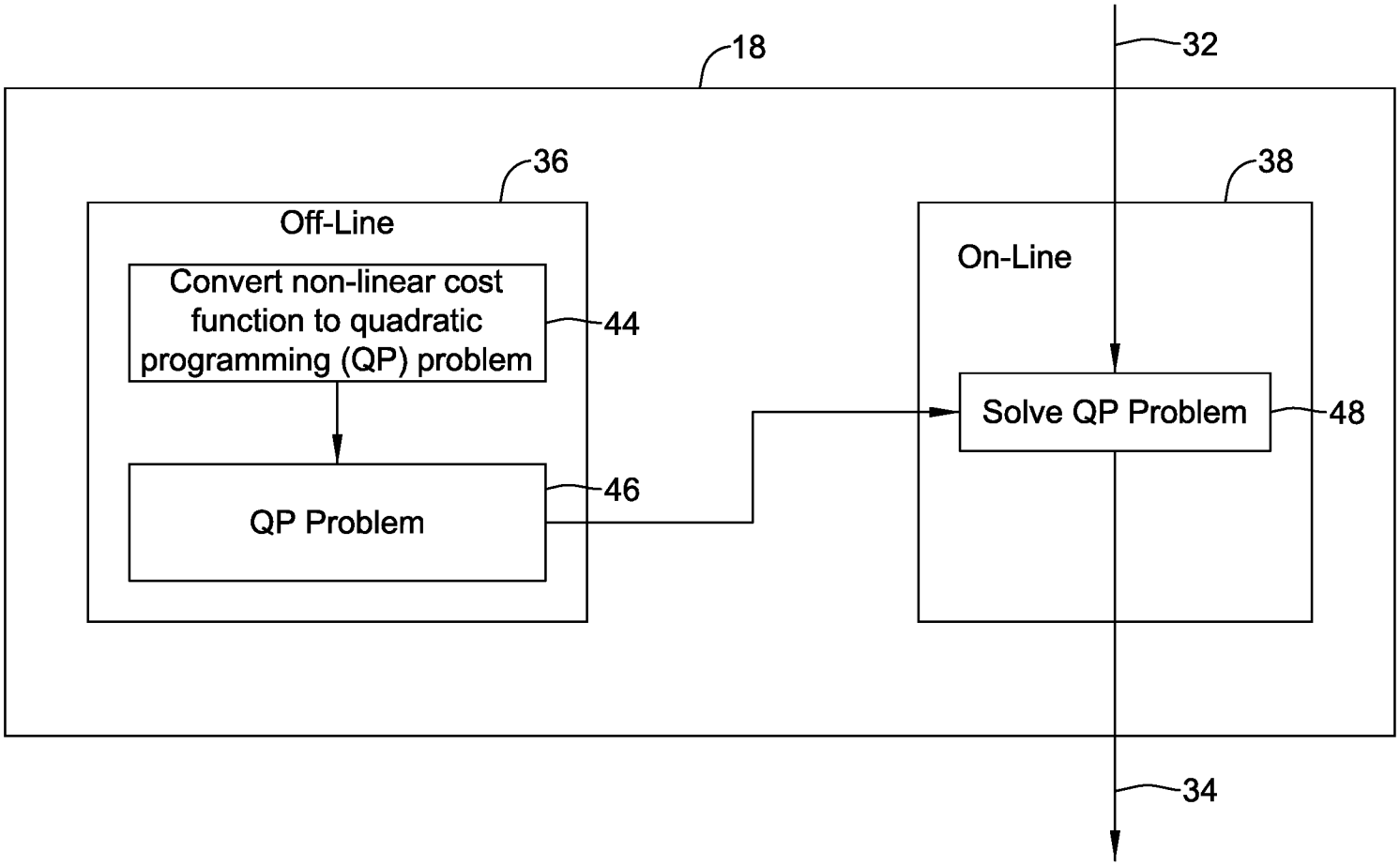
FIG. 4 is a schematic diagram of an implementation of an illustrative powertrain condition management system.

FIG. 4 depicts an additional or alternative mechanism in which the non-linear cost function in equation (2) may be transformed into a quadratic optimization problem. The transformation may change the performance cost function into a tracking problem of a few set points, where weak directions (e.g., directions where there may be little change in the cost) are removed. The set point trajectories and/or actuator positions for conditions of a powertrain system may be determined in real time, while a powertrain system 10 is operating (e.g., during steady state and/or transient operation of the powertrain system 10). In FIG. 4, the controller 18 (e.g., a multivariable controller) may include an off-line portion 36 and an on-line portion 38, where the on-line portion 38 may be configured to operate with inputs from components of the operating powertrain system 10, whereas the off-line portion 36 of the controller 18 may operate independent of components of the powertrain system 10 that are in operation.

As discussed herein, the controller 18 may be configured in one or more control components. In one example, off-line portion 36 of the controller 18 may be configured in a separate control component than a control component in which the on-line portion 38 may be configured. In such an instance, the off-line portion 36 may be configured on a personal computer, laptop computer, server, and so forth, which may be separate from the ECU/ECM of the powertrain system 10 in which the on-line portion 38 may be configured. Alternatively, or in addition, the controller 18 may be configured in one or more other control components.

The off-line portion 36 of the controller 18 may be configured in any computing device with processing power configured to convert 44 a non-linear cost function to a quadratic program (QP) problem. An illustrative non-linear model and cost function may be represented by:

$$\frac{dx_t}{dt} = f(x_t, u_t, w_t),\ J = \Sigma j(x_k, u_k, w_k),\ \text{subject to: } A_i\begin{bmatrix} x_t \\ u_t \end{bmatrix} \le b_i \tag{6}$$

To facilitate converting the non-linear cost function to a QP problem, the functions f and j of equation (6) may be approximated as follows:

$$\frac{dx_t}{dt} \approx x_t + B_u u_t + B_w w_t,\ J \approx \Sigma\frac{1}{2}\begin{pmatrix} x_k \\ u_k \end{pmatrix}^T H(w_k)\begin{pmatrix} x_k \\ u_k \end{pmatrix} + f(w_k)^T\begin{pmatrix} x_k \\ u_k \end{pmatrix} \tag{7}$$

Then, equation (7) may be converted 44 to a QP tracking problem 46 (e.g., using Hessian eigenvectors) and tuned to the controller, which may result in:

$$J = \Sigma\,||\,z(t+k) - r(t+k)\,||_2^2 + R_\Delta \Sigma\,||\,u(t+k) - u(t+k-1)\,||_2^2 \tag{8}$$

The on-line portion 38 of the controller 18 may be configured to solve 48 the QP problem 46, as in equation (8), subject to:

$$\begin{aligned} z_t &= \sqrt{S}\,V^T\begin{bmatrix} x_t \\ u_t \end{bmatrix} \\ r_t &= \sqrt{S^{-1}}\,V^T f(w_t) \\ x_{t+1} &= Ax_t + B_u u_t + B_w w_t \\ F\begin{bmatrix} x(t+k) \\ u(t+k) \end{bmatrix} &\le b \end{aligned} \tag{9}$$

which may represent a linear plant model and constraints. From solving for equation (8) in view of equation (9), the on-line portion 38 may identify set point trajectories for conditions (e.g., thermal conditions) of the powertrain system 10. Then, based, at least in part, on the identified set point trajectories and current operating conditions of the cooling system 12, the engine 14, and/or other components of the powertrain system 10 (e.g., inputs 32 from sensors 16 and/or other values for operating variables including, but not limited to, positions of actuators), the on-line portion 38 of the controller 18 may optimize the cost function in view of the identified set point trajectories to determine positions of actuators 20, 22 of the cooling system 12 and/or engine 14 (and/or of other components of the powertrain system 10). The determined positions of actuators 20, 22 (e.g., manipulated variables) may be configured to drive values of one or more conditions (e.g., a controlled variable) to an associated set point trajectory and output 34 to various actuators 20, 22 of the powertrain system 10.

Figure 5:
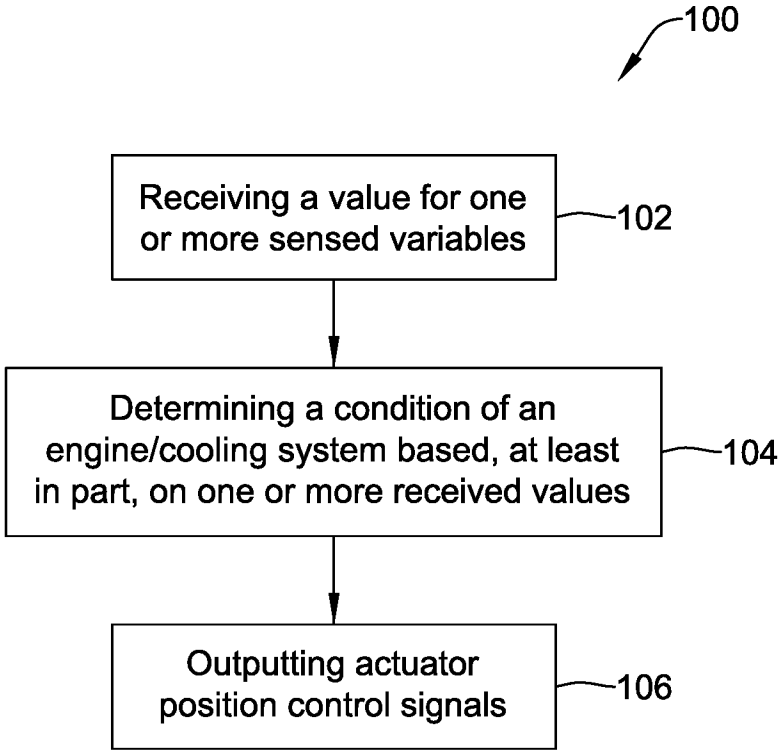
FIG. 5 is a schematic flow diagram of an illustrative approach for managing a condition of a powertrain system.

FIG. 5 depicts an illustrative approach 100 of thermal management of a powertrain system in accordance with the powertrain system 10 disclosed herein. The approach 100 may include receiving 102 one or more values for one or more variables sensed in a component (e.g., cooling system 12, engine 14, or other component) of the powertrain system 10. Based, at least in part, on the received value(s) for one or more variables sensed in the component(s) of the powertrain system 10, a set point trajectory for a condition (e.g., a temperature, pressure, flow, or other condition) of one or more components of the powertrain system 10 may be determined 104. In one example, the set point trajectory for the condition of the one or more components of the powertrain system 10 may be determined based, at least in part, on a cost function for the operation of the powertrain system 10 and/or a component thereof. Once, the set point trajectory or trajectories are known, the controller 18 may determine optimal positions of actuators (e.g., actuators 20, 22 or other actuators) of the cooling system 12, engine 14, and/or other components of the powertrain system 10 based on received inputs during operation of the engine 14 and/or other components of the powertrain system 10. These positions of actuators may be outputted 106 as control signals configured to accordingly adjust positions of the actuators 20, 22. In some cases, the control signals may be configured to adjust actuator positions to drive a value of one or more conditions (e.g., a temperature, pressure, and/or flow) of the powertrain system 10 or component thereof to an associated set point trajectory. In some cases, the approach 100 may be performed in real time during operation of one or more components of the powertrain system 10 and implemented in a manner similar to that discussed with respect to FIG. 3, FIG. 4, or a combination of FIGS. 3 and 4.

The following is a recap of the above disclosure. A powertrain system may include an engine, a cooling system, a controller connected to the engine and the cooling system, and one or more sensors. The cooling system may be connected to the engine and may include one or more actuators. The sensor(s) may be in communication with the controller and may sense values of one or more variables of the engine and/or the cooling system. The controller may be configured to control positions of the actuators of the cooling system and receive values of variable sensed by the sensors during operation of the engine. The received values for a sensed variable may be indicative of one or more conditions of the engine and/or the cooling system. The controller may be configured to further adjust one or more positions of the actuators of the cooling system to drive a value of the one or more conditions to associated condition set point trajectories for the engine and/or cooling system.

The controller of the powertrain system may be configured to determine condition set point trajectories associated with the one or more conditions of the engine and/or the cooling system. In some cases, the controller may determine condition set point trajectories associated with the one or more conditions based, at least in part, on a cost function that optimizes a set of performance variables of the engine and/or cooling system.

Further, the controller of the powertrain system may be configured to maintain each of the condition set point trajectories within predetermined constraints.

Further, the controller of the powertrain system may be configured to maintain actuator positions within predetermined constraints when determining the condition set point trajectories associated with the one or more conditions.

Further, the controller of the powertrain system may be configured to use the cost function and sensor inputs to minimize one or more of fuel consumption of the engine and parasitic losses of the engine while maintaining one or more of the conditions and the positions of the actuators of the engine within respective constraints.

The controller of the powertrain system may be configured to update the condition set point trajectories during operation of the engine and/or cooling system in view of received values for one or more variables sensed by the one or more sensors during operation of the engine.

In the powertrain system, a condition of the one or more conditions may include a temperature condition, where the powertrain system may have a temperature condition set point trajectory for the temperature condition. The temperature condition set point trajectory may include one or more engine component temperature set point trajectories. Illustratively, the engine component temperature set point trajectories may incorporate one or more of an engine housing material temperature set point trajectory, an engine intake manifold air temperature set point trajectory, an engine exhaust manifold air temperature set point trajectory, an engine oil temperature set point trajectory, and a transmission oil temperature set point trajectory.

The controller of the powertrain system may incorporate a multivariable supervisory controller and two or more powertrain component controllers. The multivariable supervisory controller may be configured to determine one or more temperature condition set point trajectories. Each of the two or more powertrain component controllers may adjust positions of actuators associated with the powertrain component controller to drive a value of the temperature condition to the temperature condition set point trajectory.

The multivariable supervisory controller and the powertrain component controllers may receive values for one or more variables. The received values for one or more variables may be sensed by the one or more sensors during operation of the engine.

The controller of the powertrain system may incorporate a multivariable controller that includes an off-line portion configured to operate without input from an operating engine and an on-line portion configured to operate with input from an operating engine.

In the powertrain system, the off-line portion of the multivariable controller may be configured to convert a non-linear cost function into a quadratic programming problem.

The on-line portion of the multivariable controller may be configured to determine the engine and/or cooling system actuator positions. The actuator positions may be determined by solving, at least in part, a quadratic programming problem in view of current operating conditions of the engine and/or cooling system.

The on-line portion of the multivariable controller may be configured to set positions of engine and/or cooling system actuators. The positions of the engine and/or cooling system actuators may be set in view of condition set point trajectories and current operating conditions of the engine and/or cooling system.

The one or more conditions of the engine and/or cooling system may include one or more of a pressure condition, a flow condition, and a temperature condition of one or more of the engine and/or cooling system.

A powertrain thermal management system may incorporate a controller with memory, a processor in communication with the memory and an input/output (I/O) port. The I/O port may be in communication with one or more of the memory and the processor. The controller may be configured to receive, via the input/output port, values for one or more variables sensed by sensors monitoring an engine and/or cooling system connected to the engine. Based, at least in part, on the received values for the one or more variables, the controller may determine a set point trajectory for one or more engine component and/or cooling system temperatures. Via the input/output port, the controller may send control signals to adjust positions of engine actuators and/or cooling system actuators to drive values of the engine component temperatures to the determined set point trajectories based, at least in part, on the received values for one or more variables.

The engine component and/or cooling system temperatures of the powertrain thermal management system may include one or more of an engine housing material temperature; an engine intake manifold air temperature; an engine exhaust manifold air temperature; an engine oil temperature; and a transmission oil temperature.

The controller of the powertrain thermal management system may determine the set point trajectory for one or more engine component temperatures and/or cooling system component temperatures based, at least in part, on a powertrain cost function.

An approach of thermal management of a powertrain system may incorporate receiving a value for one or more variables sensed in an operating engine and determining a set point trajectory for a temperature condition of the engine based, at least in part, on the received value for one or more variables sensed in the operating engine. Further, the approach may incorporate outputting one or more control signals controlling positions of actuators of the engine and/or positions of actuators of a cooling system connected to the engine during operation of the engine. The control signals may be configured to adjust one or more positions of the actuators of the engine and/or of the cooling system to drive a value of the temperature condition to the determined set point trajectory for the temperature condition.

In the approach, the set point trajectory for a temperature condition of the engine may be based, at least in part, on a cost function for the operation of the engine.

In the approach, determining a set point trajectory for a temperature condition of the engine may incorporate determining a temperature set point trajectory for one or more engine components of the operating engine.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A powertrain system comprising:

an engine;

a cooling system connected to the engine and having one or more actuators;

a controller connected to the engine and the cooling system, the controller comprises a multivariable controller that includes an off-line portion configured to operate without input from an operating engine and an on-line portion configured to operate with input from an operating engine;

one or more sensors in communication with the controller and configured to sense values of one or more variables of the engine and/or the cooling system; and wherein the controller is configured to:

control positions of the one or more actuators of the cooling system;

receive values for one or more variables sensed by the one or more sensors during operation of the engine, where at least one received value for a sensed variable is indicative of one or more conditions of the engine and/or the cooling system; and adjust one or more positions of the actuators of the cooling system to drive a value of the one or more conditions to associated condition set point trajectories for the engine and/or cooling system.

2. The system of claim 1, wherein the controller is configured to determine condition set point trajectories associated with the one or more conditions based, at least in part, on a cost function that optimizes a set of performance variables of the engine and/or cooling system.

3. The system of claim 2, wherein the controller is configured to maintain each of the condition set point trajectories within predetermined constraints.

4. The system of claim 2, wherein the controller is configured to maintain actuator positions within predetermined constraints when determining the condition set point trajectories associated with the one or more conditions.

5. The system of claim 2, wherein the controller is configured to use the cost function and sensor inputs to minimize one or more of fuel consumption of the engine and parasitic losses of the engine while maintaining one or more of the conditions and the positions of the actuators of the engine within respective constraints.

6. The system of claim 1, wherein the controller is configured to update the condition set point trajectories during operation of the engine and/or cooling system in view of received values for one or more variables sensed by the one or more sensors during operation of the engine.

7. The system of claim 1, wherein:

a condition of the one or more conditions includes a temperature condition having a temperature condition set point trajectory, wherein the temperature condition set point trajectory comprises one or more engine component temperature set point trajectories; and the engine component temperature set point trajectories comprise one or more of:

an engine housing material temperature set point trajectory;

an engine intake manifold air temperature set point trajectory;

an engine exhaust manifold air temperature set point trajectory;

an engine oil temperature set point trajectory; and a transmission oil temperature set point trajectory.

8. The system of claim 1, wherein:

the controller comprises a multivariable supervisory controller and two or more powertrain component controllers;

the multivariable supervisory controller is configured to determine the temperature condition set point trajectory; and each of the two or more powertrain component controllers are configured to adjust positions of actuators associated with the powertrain component controller to drive a value of the temperature condition to the temperature condition set point trajectory.

9. The system of claim 8, wherein the multivariable supervisory controller and the powertrain component controllers receive values for one or more variables sensed by the one or more sensors during operation of the engine.

10. The system of claim 1, wherein the off-line portion of the multivariable controller is configured to convert a nonlinear cost function into a quadratic programming problem.

11. The system of claim 10, wherein the on-line portion of the multivariable controller is configured to determine the engine and/or cooling system actuator positions by solving, at least in part, a quadratic programming problem in view of current operating conditions of the engine and/or cooling system.

12. The system of claim 1, wherein the on-line portion of the multivariable controller is configured to set positions of engine and/or cooling system actuators in view of condition set point trajectories and current operating conditions of the engine and/or cooling system.

13. The system of claim 1, wherein the one or more conditions of the engine and/or cooling system include one or more of a pressure condition, a flow condition, and a temperature condition of one or more of the engine and/or cooling system.

14. A powertrain thermal management system comprising:

a multivariable controller that includes an off-line portion configured to operate without input from an operating engine and on-line portion configured to operate with input from an operating engine, the multivariable controller comprising:

a memory;

a processor in communication with the memory; and an input/output port in communication with one or more of the memory and the processor; and wherein the controller is configured to:

receive, via the input/output port, values for one or more variables sensed by sensors monitoring an engine and/or cooling system connected to the engine;

determine a set point trajectory for one or more engine components and/or cooling system temperatures based, at least in part, on the received values for one or more variables; and send, via the input/output port, control signals to adjust positions of engine actuators and/or cooling system actuators to drive values of the engine component temperatures to the determined set point trajectories based, at least in part, on the received values for one or more variables.

15. The system of claim 14, wherein the engine component and/or cooling system temperatures include one or more of:

engine housing material temperature;

engine intake manifold air temperature;

engine exhaust manifold air temperature;

engine oil temperature; and transmission oil temperature.

16. The system of claim 14, wherein the controller is configured to determine the set point trajectory for one or more engine component temperatures and/or cooling system component temperatures based, at least in part, on a powertrain cost function.

17. A method of thermal management of a powertrain system, the method comprising:

receiving a value for one or more variables sensed in an operating engine;

determining a set point trajectory for a temperature condition of the engine based, at least in part, on the received value for one or more variables sensed in the operating engine;

updating the set point trajectory for the temperature condition of the engine during operating of the engine in view of one or more received values for the one or more variable sensed in the operating engine; and outputting one or more control signals controlling positions of actuators of the engine and/or positions of actuators of a cooling system connected to the engine during operation of the engine; and wherein the control signals are configured to adjust one or more positions of the actuators of the engine and/or of the cooling system to drive a value of the temperature condition to the determined set point trajectory for the temperature condition.

18. The method of claim 17, wherein determining a set point trajectory for a temperature condition of the engine comprises determining a temperature set point trajectory for one or more of engine components of the operating engine.

19. The method of claim 17, wherein the set point trajectory for a temperature condition of the engine is based, at least in part, on a cost function for the operation of the engine.

20. A powertrain system comprising:

an engine;

a cooling system connected to the engine and having one or more actuators;

a controller connected to the engine and the cooling system;

one or more sensors in communication with the controller and configured to sense values of one or more variables of the engine and/or the cooling system; and wherein the controller is configured to:

control positions of the one or more actuators of the cooling system;

receive values for one or more variables sensed by the one or more sensors during operation of the engine, where at least one received value for a sensed variable is indicative of one or more conditions of the engine and/or the cooling system;

adjust one or more positions of the actuators of the cooling system to drive a value of the one or more conditions to associated condition set point trajectories for the engine and/or cooling system; and update the condition set point trajectories during operation of the engine and/or cooling system in view of received values for one or more variables sensed by the one or more sensors during operation of the engine.

21. A powertrain thermal management system comprising:

a controller comprising:

a memory;

a processor in communication with the memory; and an input/output port in communication with one or more of the memory and the processor; and wherein the controller is configured to:

receive, via the input/output port, values for one or more variables sensed by sensors monitoring an engine and/or cooling system connected to the engine;

determine a set point trajectory for one or more engine components and/or cooling system temperatures based, at least in part, on the received values for one or more variables;

send, via the input/output port, control signals to adjust positions of engine actuators and/or cooling system actuators to drive values of the engine component temperatures to the determined set point trajectories based, at least in part, on the received values for one or more variables; and wherein the engine component and/or cooling system temperatures include one or more of:

engine housing material temperature;

engine intake manifold air temperature;

engine exhaust manifold air temperature;

engine oil temperature; and transmission oil temperature.

* * * * *